US010838316B2

(12) United States Patent
Miyamoto et al.

(10) Patent No.: US 10,838,316 B2
(45) Date of Patent: Nov. 17, 2020

(54) IMAGE FORMING APPARATUS

(71) Applicant: CANON KABUSHIKI KAISHA, Tokyo (JP)

(72) Inventors: Akinori Miyamoto, Bando (JP); Kota Mori, Abiko (JP); Masami Hano, Abiko (JP); Takashi Kase, Tokyo (JP); Tadashi Fukuda, Tokyo (JP); Mikihiro Akasaki, Matsudo (JP); Takeshi Ohtsu, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/550,009

(22) Filed: Aug. 23, 2019

(65) Prior Publication Data

US 2020/0073267 A1 Mar. 5, 2020

(30) Foreign Application Priority Data

| | | |
|---|---|---|
| Aug. 28, 2018 | (JP) | 2018-159786 |
| Aug. 28, 2018 | (JP) | 2018-159787 |
| Aug. 28, 2018 | (JP) | 2018-159788 |
| Aug. 19, 2019 | (JP) | 2019-150041 |
| Aug. 19, 2019 | (JP) | 2019-150042 |
| Aug. 19, 2019 | (JP) | 2019-150043 |

(51) Int. Cl.

| | |
|---|---|
| ***G03G 9/08*** | (2006.01) |
| ***G03G 9/097*** | (2006.01) |
| ***G03G 9/087*** | (2006.01) |
| ***G03G 15/16*** | (2006.01) |
| ***G03G 21/00*** | (2006.01) |
| ***G03G 15/02*** | (2006.01) |

(52) U.S. Cl.

CPC ..... *G03G 9/09725* (2013.01); *G03G 9/0815* (2013.01); *G03G 9/0819* (2013.01); *G03G 9/0821* (2013.01); *G03G 9/08782* (2013.01); *G03G 9/09708* (2013.01); *G03G 15/0233* (2013.01); *G03G 15/0291* (2013.01); *G03G 15/1675* (2013.01); *G03G 21/0011* (2013.01)

(58) Field of Classification Search

CPC ..... G03G 9/09725; G03G 9/09708
USPC ..... 430/123.5
See application file for complete search history.

(56) References Cited

U.S. PATENT DOCUMENTS

| | | | |
|---|---|---|---|
| 2011/0103836 | A1 | 5/2011 | Adachi |
| 2015/0268576 | A1 | 9/2015 | Saito et al. |

FOREIGN PATENT DOCUMENTS

| | | | |
|---|---|---|---|
| EP | 1975727 | A1 | 10/2008 |
| EP | 2192448 | A1 | 6/2010 |
| EP | 2818932 | A1 | 12/2014 |
| EP | 2853945 | A1 | 4/2015 |
| EP | 3379334 | A1 | 9/2018 |
| JP | 2004-037786 | A | 2/2004 |
| JP | 2004-309910 | A | 11/2004 |
| JP | 2005-107365 | A | 4/2005 |

(Continued)

*Primary Examiner* — Mark A Chapman
(74) *Attorney, Agent, or Firm* — Canon U.S.A., Inc. IP Division

(57) ABSTRACT

An image forming apparatus in which occurrence of an image failure in association with contamination caused by an external additive, such as silica, adhering to a charging unit is suppressed. The image forming apparatus is configured to charge an image bearing member through use of the charging unit, and uses toner having, on a surface thereof, strontium titanate particles and silica particles having predetermined physical properties.

17 Claims, 10 Drawing Sheets

(56) References Cited

FOREIGN PATENT DOCUMENTS

| | | | |
|---|---|---|---|
| JP | 2005-338750 | A | 12/2005 |
| JP | 2010-044113 | A | 2/2010 |

IMAGE FORMING APPARATUS

BACKGROUND OF THE INVENTION

Field of the Invention

The present disclosure relates to an image forming apparatus for visualizing an electrostatic image.

Description of the Related Art

In recent years, image forming apparatus, such as a copying machine and a printer, have become widespread. Along with this, as performance required in the image forming apparatus, there has been a demand for higher image quality in addition to a higher speed and a longer lifetime.

As means for improving the image quality of the image forming apparatus, toner particles are being reduced in diameter.

When the particle diameter of toner is reduced, the toner is not easily scraped off by a cleaning blade in a cleaning step, and a cleaning defect, in which the toner easily slips through the cleaning blade, is liable to occur.

In addition, as a fluidity imparting agent, particles each having a particle diameter of less than 50 nm, such as silica, are externally added to a developer in many cases, and such particles slip through a cleaning unit to adhere to a charging unit. Once those minute particles adhere to the charging unit, it is difficult to remove the particles even with a cleaning member, a bias, or the like. Further, when those minute particles non-uniformly adhere to the charging unit in a large amount, charging in the charging unit may be non-uniform.

As a method in which a cleaning defect is reduced, in Japanese Patent Application Laid-Open No. 2005-338750, there has been proposed a method involving adding strontium titanate powder to toner particles. The strontium titanate powder used in this method has an excellent abrasive effect, and hence is effective for preventing filming and fusion caused by adhesion of toner to a photosensitive member. However, the strontium titanate powder is insufficient for removing silica and the like adhering to the charging unit.

SUMMARY OF THE INVENTION

According to a first embodiment of the present disclosure, there is provided an image forming apparatus including: an image bearing member; a charging unit configured to rotate while being brought into contact with the image bearing member; a voltage applying unit configured to apply only a DC voltage to the charging unit; an exposure unit configured to form an electrostatic latent image on a surface of the image bearing member subjected to charging treatment; a developing unit configured to develop the electrostatic latent image through use of toner to form a toner image; a transfer unit configured to transfer the toner image onto a transfer material; a cleaning unit configured to clean the toner remaining on the surface of the image bearing member; and a fixing unit configured to fix the toner image transferred onto the transfer material, wherein the charging unit includes a charging roller, wherein the charging roller has an outermost surface layer including a particle portion and a non-particle portion, wherein the outermost surface layer has a ten-point average roughness Rz of from 1 μm to 20 μm, wherein the non-particle portion of the outermost surface layer has a ten-point average roughness Rz of 1.0 μm or less, wherein the toner contains toner particles, and strontium titanate particles and silica particles that are present on surfaces of the toner particles, wherein the strontium titanate particles satisfy the following conditions:

(i) the strontium titanate particles have a number average particle diameter (D1T) of primary particles of from 10 nm or more to less than 95 nm;

(ii) the strontium titanate particles have an average circularity of from 0.700 or more to 0.920 or less;

(iii) the strontium titanate particles have a maximum peak (a) at a diffraction angle (2θ) of from 32.00 deg or more to 32.40 deg or less in CuKα characteristic X-ray diffraction, the maximum peak (a) has a half width of from 0.23 deg or more to 0.50 deg or less, and an intensity (Ia) of the maximum peak (a) and a maximum peak intensity (Ix) within a range of a diffraction angle (2θ) of from 24.00 deg or more to 28.00 deg or less in the CuKα characteristic X-ray diffraction satisfy the following expression (1);

$$(Ix)/(Ia)<0.010 \qquad \text{Expression (1)}$$

(iv) when elements detected by fluorescent X-ray analysis are all assumed to be contained as oxides, a total of contents of strontium oxide and titanium oxide with respect to 100% by mass of a total amount of all the oxides is 98.0% by mass or more, wherein the silica particles have a number average particle diameter (D1S) of primary particles of from 5 nm or more to 300 nm or less, and wherein an amount of the strontium titanate particles separated from the toner when the toner is washed with water is 0.2 time or more as large as an amount of the silica particles separated from the toner when the toner is washed with water.

According to a second embodiment of the present disclosure, there is provided an image forming apparatus including: an image bearing member; a charging unit configured to rotate while being brought into contact with the image bearing member; a voltage applying unit configured to apply a DC voltage and an AC voltage to the charging unit; an exposure unit configured to form an electrostatic latent image on a surface of the image bearing member subjected to charging treatment; a developing unit configured to develop the electrostatic latent image through use of toner to form a toner image; a transfer unit configured to transfer the toner image onto a transfer material; a cleaning unit configured to clean the toner remaining on the surface of the image bearing member; and a fixing unit configured to fix the toner image transferred onto the transfer material, wherein the charging unit includes a charging roller, wherein the charging roller has an outermost surface layer including a particle portion and a non-particle portion, wherein the outermost surface layer has a ten-point average roughness Rz of from 1 μm to 20 μm, wherein the non-particle portion of the outermost surface layer has a ten-point average roughness Rz of 1.0 μm or less, wherein the toner contains toner particles, and strontium titanate particles and silica particles that are present on surfaces of the toner particles, wherein the strontium titanate particles satisfy the following conditions:

(i) the strontium titanate particles have a number average particle diameter (D1T) of primary particles of from 10 nm or more to less than 95 nm;

(ii) the strontium titanate particles have an average circularity of from 0.700 or more to 0.920 or less;

(iii) the strontium titanate particles have a maximum peak (a) at a diffraction angle (2θ) of from 32.00 deg or more to 32.40 deg or less in CuKα characteristic X-ray diffraction, the maximum peak (a) has a half width of from 0.23 deg or more to 0.50 deg or less, and an intensity (Ia) of the maximum peak (a) and a maximum peak intensity (Ix) within a range of a diffraction angle (2θ) of from 24.00 deg or more to 28.00 deg or less in the CuKα characteristic X-ray diffraction satisfy the following expression (1):

$$(Ix)/(Ia) \leq 0.010 \quad \text{Expression (1)}$$

(iv) when elements detected by fluorescent X-ray analysis are all assumed to be contained as oxides, a total of contents of strontium oxide and titanium oxide with respect to 100% by mass of a total amount of all the oxides is 98.0% by mass or more, wherein the silica particles have a number average particle diameter (D1S) of primary particles of from 5 nm or more to 300 nm or less, and wherein an amount of the strontium titanate particles separated from the toner when the toner is washed with water is from 0.01 time or more to 0.6 time or less as large as an amount of the silica particles separated from the toner when the toner is washed with water.

According to a third embodiment of the present disclosure, there is provided an image forming apparatus including: an image bearing member; a corona discharge-type charging unit including a discharge electrode arranged so as to be opposed to the image bearing member; a cleaning unit for the discharge electrode, which is configured to clean a surface of the discharge electrode by being brought into contact with the discharge electrode; an exposure unit configured to form an electrostatic latent image on a surface of the image bearing member subjected to charging treatment; a developing unit configured to develop the electrostatic latent image through use of toner to form a toner image; a transfer unit configured to transfer the toner image onto a transfer material; a cleaning unit configured to clean the toner remaining on the surface of the image bearing member; and a fixing unit configured to fix the toner image transferred onto the transfer material, wherein the toner contains toner particles, and strontium titanate particles and silica particles that are present on surfaces of the toner particles, wherein the strontium titanate particles satisfy the following conditions:

(i) the strontium titanate particles have a number average particle diameter (D1T) of primary particles of from 10 nm or more to less than 95 nm;

(ii) the strontium titanate particles have an average circularity of from 0.700 or more to 0.920 or less;

(iii) the strontium titanate particles have a maximum peak (a) at a diffraction angle (2θ) of from 32.00 deg or more to 32.40 deg or less in CuKα characteristic X-ray diffraction, the maximum peak (a) has a half width of from 0.23 deg or more to 0.50 deg or less, and an intensity (Ia) of the maximum peak (a) and a maximum peak intensity (Ix) within a range of a diffraction angle (2θ) of from 24.00 deg or more to 28.00 deg or less in the CuKα characteristic X-ray diffraction satisfy the following expression (1);

$$(Ix)/(Ia) < 0.010 \quad \text{Expression (1)}$$

(iv) when elements detected by fluorescent X-ray analysis are all assumed to be contained as oxides, a total of contents of strontium oxide and titanium oxide with respect to 100% by mass of a total amount of all the oxides is 98.0% by mass or more, wherein the silica particles have a number average particle diameter (D1 S) of primary particles of from 5 nm or more to 300 nm or less, and wherein an amount of the strontium titanate particles separated from the toner when the toner is washed with water is from 0.01 time or more to 0.9 time or less as large as an amount of the silica particles separated from the toner when the toner is washed with water.

According to at least one embodiment of the present disclosure, the image forming apparatus, in which the adhesion of the external additive contained in the toner to a charging member is suppressed so that stable image characteristics can be maintained at a high level, can be provided.

Further features of the present disclosure will become apparent from the following description of exemplary embodiments with reference to the attached drawings.

DESCRIPTION OF THE EMBODIMENTS

Now, embodiments of the present disclosure are described in detail in an illustrative manner with reference to the drawings. Dimensions, materials, shapes, relative arrangement, and the like of constituent components described in those embodiments should be appropriately changed depending on the configuration of an apparatus to which the present disclosure is applied and various conditions, and the scope of the present invention is not limited to the following embodiments.

Apparatus Portions in First Embodiment and Second Embodiment (Description of Each Portion of Image Forming Apparatus)

Figure 1:
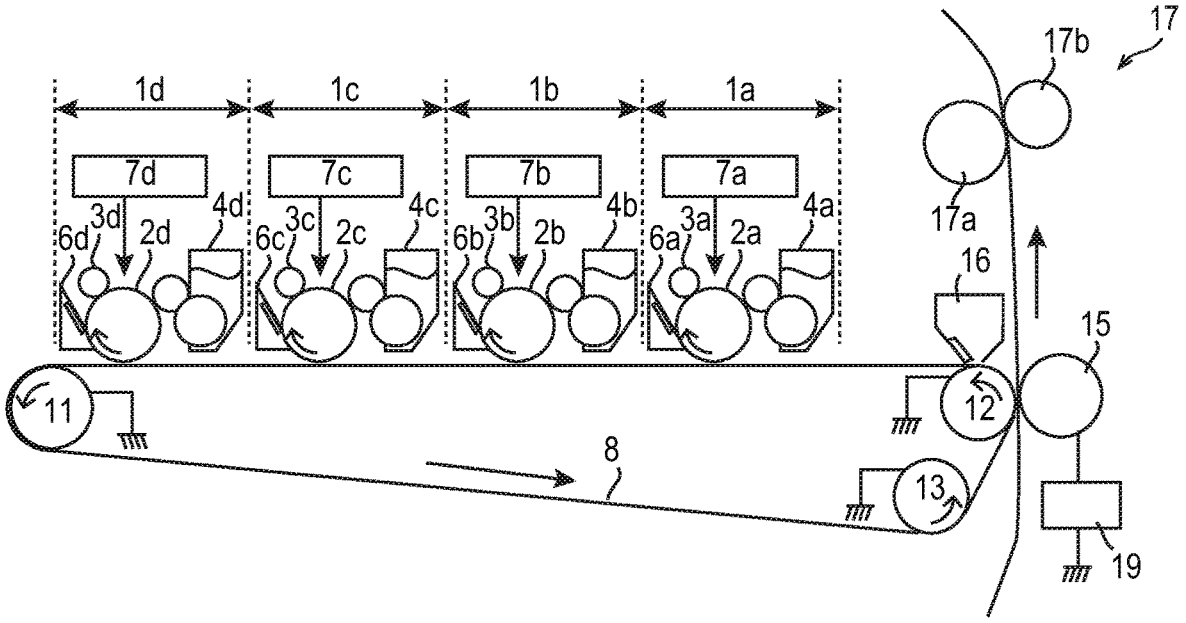
FIG. 1 is a schematic configuration view of an image forming apparatus according to a first embodiment and a second embodiment of the present disclosure.

FIG. 1 is a configuration view of a color image forming apparatus of an inline type (4-drum system). The image forming apparatus includes the following four image forming portions (image forming units): an image forming portion 1*a* configured to form an image of a yellow color, an image forming portion 1*b* configured to form an image of a magenta color, an image forming portion 1*c* configured to form an image of a cyan color, and an image forming portion 1*d* configured to form an image of a black color. Those four image forming portions are arranged in a row at certain intervals.

Photosensitive drums 2*a*, 2*b*, 2*c*, and 2*d* that are image bearing members are arranged in the image forming portions 1*a*, 1*b*, 1*c*, and 1*d*, respectively. In those embodiments, the photosensitive drums 2*a*, 2*b*, 2*c*, and 2*d* are each an organic photosensitive member that is negatively charged, and each have a photosensitive layer (not shown) on a drum base (not shown) made of aluminum or the like. The photosensitive drums 2*a*, 2*b*, 2*c*, and 2*d* are driven to rotate at a predetermined process speed by a drive device (not shown).

Charging rollers 3*a*, 3*b*, 3*c*, and 3*d* and developing devices 4*a*, 4*b*, 4*c*, and 4*d* are arranged on the periphery of the photosensitive drums 2*a*, 2*b*, 2*c*, and 2*d*, respectively. The charging roller is a charging unit having a roller shape, which is configured to rotate while being brought into contact with the photosensitive drum and charge the photosensitive drum. In the first embodiment, a voltage applying unit (not shown) configured to apply a DC voltage is connected to the charging roller. In the second embodiment, a voltage applying unit (not shown) configured to apply a DC voltage and an AC voltage is connected to the charging roller.

Further, exposure units (hereinafter sometimes referred to as "exposure devices") 7*a*, 7*b*, 7*c*, and 7*d* each configured to form an electrostatic latent image on a surface of the photosensitive drum subjected to charging treatment are installed above the photosensitive drums 2*a*, 2*b*, 2*c*, and 2*d*, respectively. Yellow toner, cyan toner, magenta toner, and black toner are stored in developing units (hereinafter sometimes referred to as "developing devices") 4*a*, 4*b*, 4*c*, and 4*d*, respectively. The developing device is configured to develop the electrostatic latent image formed on the surface of the photosensitive drum to form a toner image.

Cleaning members (hereinafter sometimes referred to as "drum cleaning devices") 6*a*, 6*b*, 6*c*, and 6*d* each configured to clean toner remaining on the surface of the photosensitive drum are installed on the periphery of the photosensitive drums 2*a*, 2*b*, 2*c*, and 2*d*, respectively.

A rotatable endless intermediate transfer belt 8 that is an intermediate transfer member is installed at a position opposed to each of the image forming portions 1*a*, 1*b*, 1*c*, and 1*d*. The intermediate transfer belt 8 is stretched by a drive roller 11, a secondary transfer opposing roller 12, and a tension roller 13. Through drive of the drive roller 11 connected to a motor (not shown), the intermediate transfer belt 8 is rotated (moved) in an arrow direction (counterclockwise direction). The secondary transfer opposing roller 12 is brought into abutment against a secondary transfer roller 15 through intermediation of the intermediate transfer belt 8 to form a secondary transfer portion.

A belt cleaning device 16 is installed on an outer side of the intermediate transfer belt 8. The belt cleaning device 16 is configured to remove and collect un-transferred residual toner remaining on a surface of the intermediate transfer belt 8. In addition, a fixing unit 17 is installed on a downstream side of the secondary transfer portion in which the secondary transfer opposing roller 12 and the secondary transfer roller 15 are brought into abutment against each other in a rotation direction of the intermediate transfer belt 8. The fixing unit 17 is configured to perform heat and pressure treatment for fixing toner onto a transfer material. The fixing unit 17 includes a fixing roller 17*a* and a pressure roller 17*b*.

(Description of Image Forming Operation)

When a start signal for starting an image forming operation is output from a controller, transfer materials (recording media) are fed one by one from a cassette (not shown) and conveyed to a registration roller (not shown). In this case, the registration roller (not shown) is suspended, and a distal end of the transfer material is caused to stand by immediately before the secondary transfer portion.

Meanwhile, in the image forming portions 1*a*, 1*b*, 1*c*, and 1*d*, when the start signal is output, the photosensitive drums 2*a*, 2*b*, 2*c*, and 2*d* start rotating at a predetermined process speed. The photosensitive drums 2*a*, 2*b*, 2*c*, and 2*d* are uniformly charged by the charging rollers 3*a*, 3*b*, 3*c*, and 3*d*, respectively. In Examples described later, the photosensitive drums 2*a*, 2*b*, 2*c*, and 2*d* are charged to a negative polarity.

Then, the exposure devices 7*a*, 7*b*, 7*c*, and 7*d* scan the photosensitive drums 2*a*, 2*b*, 2*c*, and 2*d* by exposing the photosensitive drums 2*a*, 2*b*, 2*c*, and 2*d* to laser light, respectively, to thereby form electrostatic latent images. Regarding the electric potential of the photosensitive drum, the charge quantity and exposure amount are adjusted so that the electric potential of the photosensitive drum reaches −600 V after the photosensitive drum is charged by the charging roller, and the electric potential (image portion) of the photosensitive drum reaches −200 V after the photosensitive drum is exposed to light by the exposure device, and the developing bias is set to −500 V. The process speed (drive speed of the photosensitive drum) is set to 240 mm/sec, and the image forming width corresponding to the length in a direction perpendicular to a conveyance direction is set to 300 mm. The toner charge quantity is set to about −30 μC/g, and the toner amount on the photosensitive drum in a solid image portion is set to about 0.4 mg/cm$^2$.

As the order for image formation, in order to first form a yellow image, yellow toner is caused to adhere to the electrostatic latent image formed on the photosensitive drum 2*a* by the developing device 4*a*, to thereby visualize the electrostatic latent image as a toner image. The yellow toner image is primarily transferred onto the rotating intermediate transfer belt 8.

A region on the intermediate transfer belt 8, which has the yellow toner image transferred thereon, is moved to the image forming portion 1*b* side through rotation of the intermediate transfer belt 8. Then, also in the image forming portion 1*b*, a magenta toner image formed on the photosensitive drum 2*b* is similarly transferred onto the intermediate transfer belt 8 so as to be superimposed on the yellow toner image thereon. After that, cyan and black toner images respectively formed on the photosensitive drums 2*c* and 2*d* of the image forming portions 1*c* and 1*d* are similarly successively superimposed on the yellow and magenta toner images transferred onto the intermediate transfer belt 8 so as to be superimposed on one another, to thereby form a full-color toner image on the intermediate transfer belt 8.

In synchronization with the timing to move a distal end of the full-color toner image formed on the intermediate transfer belt 8 to the secondary transfer portion, the transfer material is conveyed to the secondary transfer portion by the registration roller (not shown). The full-color toner image formed on the intermediate transfer belt 8 is secondarily transferred in a collective manner onto the transfer material by the secondary transfer roller 15 having a secondary transfer voltage (voltage having a polarity (positive polarity) opposite to that of toner) applied thereto. The transfer material having the full-color toner image formed thereon is conveyed to the fixing unit 17. The full-color toner image is heated and pressurized in a fixing nip portion formed between the fixing roller 17*a* and the pressure roller 17*b* and thermally fixed onto a surface of the transfer material. Then, the transfer material is delivered outside.

(Detailed Description of Charging Roller)

Figure 2:
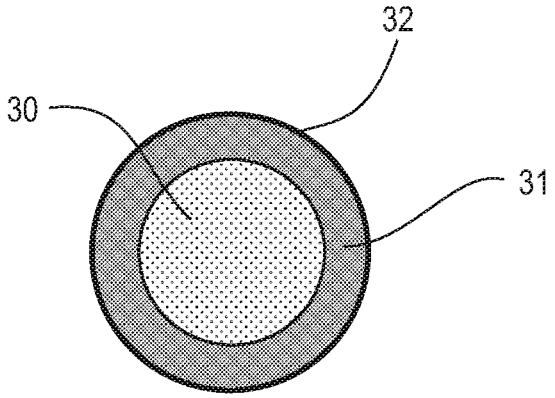
FIG. 2 is a schematic configuration view of a charging roller in the first embodiment and the second embodiment.

The charging roller 3 is described with reference to the sectional view of FIG. 2. First, an elastic layer 31 is formed on an outer periphery of a support 30, and a surface layer 32 is formed on the elastic layer 31. In general, the surface layer 32 serves as an outermost surface layer.

The outermost surface layer of the charging roller 3 includes a particle portion and a non-particle portion. The outermost surface layer has a ten-point average roughness Rz of from 1 μm to 20 μm. The ten-point average roughness Rz within a range of 10 μm×10 μm of the non-particle portion (sea part) at a time when the outermost surface layer is subjected to binarization processing is 1.0 μm or less.

The support 30 (support made of steel having a surface plated with nickel) is a shaft excellent in wear resistance and deflection stress. The elastic layer 31 may be formed through use of a rubber, a thermoplastic elastomer, or the like which has hitherto been used as an elastic layer of a charging roller. Specifically, there is given the following material: a rubber composition containing, as a base rubber, polyurethane, a silicone rubber, a butadiene rubber, an isoprene rubber, a chloroprene rubber, a styrene-butadiene rubber, an ethylene-propylene rubber, a polynorbornene rubber, a styrene-butadiene-styrene rubber, an epichlorohydrin rubber, or the like. Alternatively, there is given a thermoplastic elastomer. The kind thereof is not particularly limited, and one kind or a plurality of kinds of thermoplastic elastomers selected from a general-purpose styrene-based elastomer, a general-purpose olefin-based elastomer, and the like may be suitably used. In addition, a solid rubber may be used or a rubber foam may be used in accordance with a required elastic force.

Predetermined conductivity can be imparted to the elastic layer 31 through addition of a conductivity imparting agent. There is no particular limitation on the conductivity imparting agent to be added to the elastic layer 31, and there are given a cationic surfactant, an anionic surfactant, a zwitterionic surfactant, an antistatic agent, and an electrolyte. Examples of the cationic surfactant include: quaternary ammonium salts, such as perchlorates, chlorates, fluoroborates, ethosulfates, and benzyl halide salts (e.g., benzyl bromide salts and benzyl chloride salts) of lauryltrimethylammonium, stearyltrimethylammonium, octadodecyltrimethylammonium, dodecyltrimethylammonium, hexadecyltrimethylammonium, and a modified fatty acid-dimethylethylammonium. Examples of the anionic surfactant include: an aliphatic sulfonic acid salt, a higher alcohol sulfuric acid ester salt, a higher alcohol ethylene oxide adduct sulfuric acid ester salt, a higher alcohol phosphoric acid ester salt, and a higher alcohol ethylene oxide adduct phosphoric acid ester salt. Examples of the zwitterionic surfactant include various betaines. Examples of the antistatic agent include non-ionic antistatic agents, such as a higher alcohol ethylene oxide, a polyethylene glycol fatty acid ester, and a polyhydric alcohol fatty acid ester. Examples of the electrolyte include salts of metals of the first group of the periodic table (e.g., $Li^+$, $Na^+$, and $K^+$), such as $LiCF_3SO_3$, $NaClO_4$, $LiAsF_6$, $LiBF_4$, NaSCN, KSCN, and NaCl, and $NH^{4+}$ salts. In addition, examples of the conductivity imparting agent include salts of metals of the second group of the periodic table (e.g., $Ca^{2+}$ and $Ba^{2+}$), such as $Ca(ClO_4)_2$, and the antistatic agents each having at least one group having active hydrogen that reacts with an isocyanate, such as a hydroxyl group, a carboxyl group, or a primary or secondary amine group. Alternatively, there may be used ion conductivity imparting agents, such as complexes of the above-mentioned conductivity imparting agents with polyhydric alcohols (e.g., 1,4-butanediol, ethylene glycol, polyethylene glycol, propylene glycol, and polypropylene glycol) or derivatives thereof and complexes of the above-mentioned conductivity imparting agents with monools (e.g., ethylene glycol monomethyl ether and ethylene glycol monoethyl ether). Alternatively, there may be used: conductive carbon, such as ketjen black EC and acetylene black; carbon for a rubber, such as SAF, ISAF, HAF, FEF, GPF, SRF, FT, and MT; carbon for coloring (ink) subjected to oxidation treatment; pyrolytic carbon; natural graphite; artificial graphite; tin oxide, titanium oxide, and zinc oxide, which are doped with antimony; metals, such as nickel, copper, silver, and germanium, and metal oxides thereof; and conductive polymers, such as polyaniline, polypyrrole, and polyacetylene. In this case, the blending amounts of those conductivity imparting agents are appropriately selected in accordance with the kind of the composition, and in general, are adjusted so that the elastic layer 31 has a volume resistivity of from $10^2$ Ω·cm to $10^8$ Ω·cm, more preferably from $10^3$ Ω·cm to $10^6$ Ω·cm.

Specific examples of a material for forming the surface layer 32 include a polyester resin, an acrylic resin, a urethane resin, an acrylic urethane resin, a nylon resin, an epoxy resin, a polyvinyl acetal resin, a vinylidene chloride resin, a fluorine resin, and a silicone resin. Any one of an organic system and an aqueous system may be used. In addition, conductivity may be imparted to the surface layer 32 or conductivity thereof may be adjusted through addition of the conductivity imparting agent to the surface layer 32. There is no particular limitation on the conductivity imparting agent to be added to the surface layer 32, and there are given the following: conductive carbon, such as ketjen black EC and acetylene black; carbon for a rubber, such as SAF, ISAF, HAF, FEF, GPF, SRF, FT, and MT; carbon for coloring (ink) subjected to oxidation treatment; pyrolytic carbon; natural graphite; artificial graphite; tin oxide, titanium oxide, and zinc oxide, which are doped with antimony; and metals, such as nickel, copper, silver, and germanium, and metal oxides thereof. Further, when the conductivity imparting agent is used with an organic solvent, it is preferred that the surface of the conductivity imparting agent be subjected to surface treatment, such as silane coupling treatment, in consideration of dispersibility. In addition, the addition amount of the conductivity imparting agent may be appropriately adjusted so that the surface layer 32 has a desired electric resistance value. It has been known that, when the electric resistance value of the surface layer 32 is basically higher than that of the elastic layer 31, charging becomes stable. The surface layer 32 is required to have a volume resistivity of from $10^3$ Ω·m to $10^{15}$ Ω·m, and preferably has a volume resistivity of from $10^5$ Ω·m to $10^{14}$ Ω·m.

As particles to be added to a conductive resin layer of an outermost surface layer serving as the surface layer 32, urethane particles, nylon particles, acrylic particles, or particles made of a copolymer resin, such as acrylic-styrene, which are insulating particles ($10^{10}$ Ω·cm or more), may be used. Besides those particles, particles obtained by solidifying an inorganic material, such as silica particles, titanium oxide, zinc oxide, or tin oxide with a resin, may also be used. In order to improve dispersibility, it is more preferred that the particles be subjected to pretreatment, such as silane coupling treatment, in the same manner as in the conductivity imparting agent.

There is no particular limitation on a method of forming the charging roller 3, and a method involving preparing a coating material containing each component and applying the coating material by a dipping method, a spray method, or a roll coating method to form a coating film is preferably used. In this case, when an outer layer is formed of a plurality of layers, it is only required that dipping, spraying, or roll coating be repeated through use of a coating material for forming each layer.

<Description of Specific Manufacturing Method>

A specific manufacturing method for the charging roller 3 is described. For example, the charging roller 3 may be manufactured as described below.

[Formation of Elastic Layer]

The following components were kneaded for 20 minutes through use of an open roll.

| | |
|---|---|
| Epichlorohydrin rubber (product name: EPICHLOMER CG-102, manufactured by Daiso Co., Ltd.) | 100 parts |
| Calcium carbonate serving as a filler | 30 parts |
| Coloring-grade carbon serving as a reinforcing material for improving an abrasive property (product name: SEAST SO, manufactured by Tokai Carbon Co., Ltd.) | 2 parts |
| Zinc oxide | 5 parts |
| Dioctyl phthalate (DOP) serving as a plasticizer | 10 parts |
| 2-Mercaptobenzimidazole serving as an antioxidant | 1 part |
| Quaternary ammonium perchlorate salt represented by the following formula | 3 parts |

Quaternary ammonium perchlorate salt represented by the following formula 3 parts

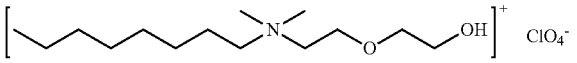

Further, the following components were added to the resultant, and the mixture was kneaded for 15 minutes through use of the open roll. Dibenzothiazyl disulfide (DM) serving as a vulcanization accelerator (product name:

| | |
|---|---|
| NOCCELER DM-P, manufactured by Ouchi Shinko Chemical Industrial Co., Ltd.) | 1 part |
| Tetramethylthiuram monosulfide (TS) serving as a vulcanization accelerator (product name: NOCCELER TS, manufactured by Ouchi Shinko Chemical Industrial Co., Ltd.) | 0.5 part |
| Sulfur serving as a vulcanizing agent | 1 part |

The obtained kneaded product was extruded into a cylindrical shape with a rubber extruder and cut. The resultant was primarily vulcanized with water vapor at a temperature of 160° C. for 40 minutes through use of a vulcanizer to obtain a primary vulcanized tube.

Next, a thermosetting adhesive for a metal and a rubber (product name: METALOC U-20, manufactured by Toyokagaku Kenkyusho Co., Ltd.) was applied to a center portion in an axial direction of a cylindrical surface of the support 30 having a cylindrical shape (support made of steel having a surface plated with nickel). The resultant was dried at a temperature of 80° C. for 30 minutes, and further dried at a temperature of 120° C. for 1 hour. This support was inserted into the primarily vulcanized tube. Then, the resultant was heated at a temperature of 160° C. for 2 hours in an electric oven to perform secondary vulcanization and curing of the adhesive, to thereby obtain an unabraded product.

Both ends of a rubber portion of the unabraded product were cut, and the rubber portion was abraded with a grinding stone, to thereby obtain a roller having a conductive elastic layer (ten-point average roughness Rz: 7 μm) on the support.

[Formation of Surface Layer]

450 parts of a 1% isopropyl alcohol solution of trifluoropropyltrimethoxysilane and 300 parts of glass beads having an average particle diameter of 0.8 mm were added to 50 parts of conductive tin oxide powder (product name: SN-100P, manufactured by Ishihara Sangyo Kaisha, Ltd.). The resultant was dispersed with a paint shaker for 48 hours. Then, the dispersion liquid was filtered with a 500-mesh net. Next, the solution was warmed in a hot bath at 100° C. with stirring through a Nauta mixer to allow the alcohol to evaporate. Thus, the solution was dried. A silane coupling agent was added to the surface of the resultant to obtain conductive tin oxide particles subjected to surface treatment.

In addition, 145 parts of lactone-modified acrylic polyol (product name: Placcel DC2009 (hydroxyl value: 90 KOH mg/g), manufactured by Daicel Corporation) was dissolved in 455 parts of methylisobutyl ketone (MIBK) to obtain a solution containing a solid content of 24.17% by mass.

The following components were added to 200 parts of the acrylic polyol solution.

| | |
|---|---|
| Conductive tin oxide particles subjected to surface treatment | 50 parts |
| Silicone oil (product name: SH-28PA, manufactured by Dow Corning Toray Co., Ltd.) | 0.01 part |
| Silica fine particles (primary particle diameter: 0.02 μm) | 1.2 parts |
| Monodispersed crosslinked acrylic resin particles each having a large particle diameter (product name: Chemisnow MX-1000 (number average particle diameter: 10 μm), manufactured by Soken Chemical & Engineering Co., Ltd.) | 4.5 parts |
| Monodispersed crosslinked acrylic resin particles each having a small particle diameter (product name: Chemisnow MX-500 (number average particle diameter: 5 μm), manufactured by Soken Chemical & Engineering Co., Ltd.) | 18 parts |
| Glass beads each having a diameter of 0.8 mm | 200 parts |

The obtained mixture was placed in a 450 mL mayonnaise bottle and dispersed for 12 hours through use of a paint shaker with cooling.

Further, the following components were mixed with 330 parts of the dispersion liquid, followed by stirring with a ball mill for 1 hour. Finally, the resultant solution was filtered with a 200-mesh net to obtain a coating material for a surface layer having a solid content concentration of 43% by mass.

| | |
|---|---|
| Isocyanurate-type trimer of a block type of isophorone diisocyanate (IPDI) (product name: VESTANAT B1370, manufactured by Degussa-Huels AG) | 27 parts |
| Isocyanurate-type trimer of hexamethylene diisocyanate (HDI) (product name: DURANATE TPA-B80E, manufactured by Asahi Kasei Kogyo Co., Ltd.) | 17 parts |

The coating material for a surface layer was applied to the surface of the roller having a conductive elastic layer (ten-point average roughness Rz: 7 μm) on the support by dipping. The coating material for a surface layer was applied to the surface of the roller at a lifting speed of 400 mm/min and dried with air for 30 minutes. After that, the axial direction was reversed. The coating material for a surface layer was again applied to the surface of the roller at a lifting speed of 400 mm/min and dried with air for 30 minutes. Then, the resultant was dried at a temperature of 160° C. for 1 hour through use of an oven. After that, the resultant was allowed to stand still in an environment having a room temperature of 25° C. and a relative humidity of 50% for 48 hours.

The obtained charging roller had an outermost surface layer (thickness: 15 μm) including a particle portion and a non-particle portion. The outermost surface layer had a ten-point average roughness Rz of 13.3 μm, and the non-particle portion of the outermost surface layer had a ten-point average roughness Rz of 0.94 μm.

<Description of Measurement Method for Surface Property of Charging Roller>

In the present disclosure, Rz refers to a ten-point average roughness defined by JIS B0601 (1994). A surface image of the charging roller was taken with an objective lens having a magnification of 50 times through use of a laser microscope (VK-X1000, manufactured by Keyence Corporation) to acquire two-dimensional height data of an area having dimensions of 273 μm (width)×204 μm (length), and automatic correction was performed with respect to a curvature of the surface. Then, an average value of ten-point average roughnesses at three positions in a circumferential direction (in units of 120° with a suitable position being a starting point) was determined through use of analysis application manufactured by Keyence Corporation.

In addition, also regarding the surface roughness of the non-particle portion (sea part) of the surface of the charging roller, a surface image of the charging roller was taken with an objective lens having a magnification of 50 times through use of the laser microscope (VK-X1000, manufactured by Keyence Corporation). Then, automatic correction was performed with respect to a curvature of the surface, and binarization processing was performed based on a histogram peak of roughness (when there are a plurality of peaks, a peak value on a lower limit side is defined as a reference). The remaining portion was determined to be the sea part. Ten square regions each having dimensions of 10 μm (width)×10 μm (length) were selected from the portion determined to be the sea part, and an average value of ten-point average roughnesses in those ten regions was determined.

In addition, the influence of variation cannot be avoided merely by determining an average value of ten-point average roughnesses from one image. Therefore, images were taken at nine positions in total including three positions in a rotation direction in each of three positions (center position, position of 2 cm from a left end, and position of 2 cm from a right end) in a longitudinal direction of one charging roller.

Then, ten positions were selected from each image, and an average value of ten-point average roughnesses in those ten positions was determined. Specifically, an average value of ten-point average roughnesses at the ten positions selected from a first image, an average value of ten-point average roughnesses at the ten positions selected from a second image, . . . , and an average value of ten-point average roughnesses at the ten positions selected from a ninth image were determined.

Further, the sum of the average value calculated from the first image, the average value calculated from the second image, . . . and the average value calculated from the ninth image was divided by 9 to determine an average value of the average values. Through determination of the average value of the average values of the images, the influence of variation was sufficiently reduced.

Apparatus Portion in Third Embodiment

<Image Forming Step>

(Description of Each Portion of Image Forming Apparatus)

Figure 4:
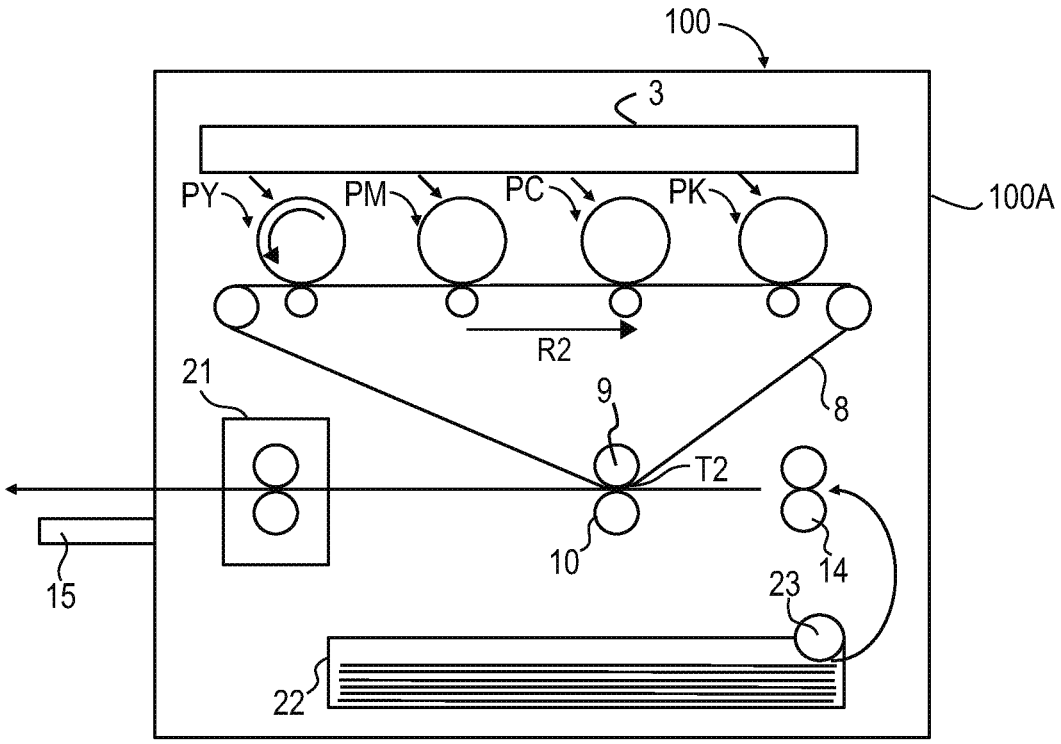
FIG. 4 is a schematic configuration view of an image forming apparatus according to a third embodiment of the present disclosure.
Figure 5:
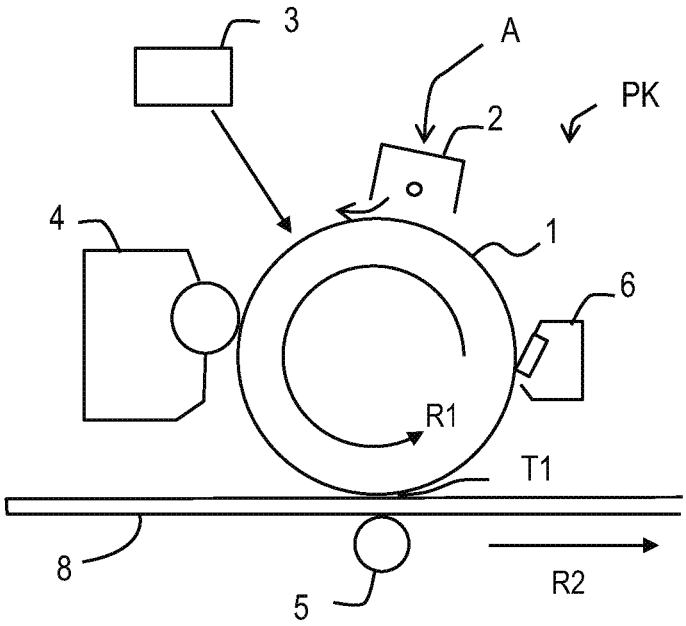
FIG. 5 is a schematic configuration view of an image forming apparatus having a corona charger in the third embodiment.

A schematic configuration of an image forming apparatus according this embodiment is described with reference to FIG. 4 and FIG. 5. FIG. 4 is an overall schematic view of the image forming apparatus. FIG. 5 is a schematic view of an image forming portion.

An image forming apparatus 100 illustrated in FIG. 1 is an electrophotographic tandem-type full-color printer. The image forming apparatus 100 includes image forming portions PY, PM, PC, and PK configured to form images of yellow, magenta, cyan, and black, respectively. The image forming apparatus 100 is configured to form a toner image on a recording material in accordance with an image signal output from an original reading apparatus (not shown) connected to an apparatus main body 100A or external equipment (not shown) such as a personal computer connected to the apparatus main body 100A so that communication is enabled therebetween. As the recording material, there are given sheet materials such as a sheet, a plastic film, and cloth.

As illustrated in FIG. 4, the image forming portions PY, PM, PC, and PK are arranged side by side along a movement direction of the intermediate transfer belt 8. The intermediate transfer belt 8 is configured to be stretched by a plurality of rollers to travel in a direction indicated by the arrow R2. Then, the intermediate transfer belt 8 is configured to carry and convey the toner image that is primarily transferred thereto as described later. A secondary transfer roller 10 is arranged at a position at which the secondary transfer roller 10 is opposed to a roller 9 configured to stretch the intermediate transfer roller 8 with the intermediate transfer belt 8 interposed therebetween and forms a secondary transfer portion T2 configured to transfer the toner image on the intermediate transfer belt 8 onto the recording material. A fixing device 21 is arranged on a downstream side in a recording material conveyance direction of the secondary transfer portion T2.

A cassette 22 configured to accommodate the recording material is arranged in a lower portion of the image forming apparatus 100. The recording material is conveyed from the cassette 22 to a registration roller 14 by a conveyance roller 23. After that, the registration roller 14 starts rotating in synchronization with the toner image on the intermediate transfer belt 8, and thus the recording material is conveyed to the secondary transfer portion T2.

The four image forming portions PY, PM, PC, and PK included in the image forming apparatus 100 have substantially the same configuration except for the difference in developing color. Therefore, the image forming portion PK is described as a representative, and description of the other image forming portions is omitted.

As illustrated in FIG. 5, a photosensitive drum 1 is arranged in the image forming portion PK. The photosensitive drum 1 is formed so as to have, for example, an outer diameter of 84 mm and a length of 380 mm, and is rotated at a rotation speed of, for example, 450 mm/s in a direction indicated by the arrow R1. A corona charger 2, an exposure device 3, a developing device 4, a primary transfer roller 5, and a cleaning device 6 are arranged on the periphery of the photosensitive drum 1.

A process of forming, for example, a full four-color image by the image forming apparatus 100 configured as described above is described.

First, when an image forming operation is started, the surface of the rotating photosensitive drum 1 is uniformly charged by the corona charger 2. The corona charger 2 is configured to irradiate the photosensitive drum 1 with charged particles in association with corona discharge to charge the photosensitive drum 1 to a uniform negative dark portion potential. The charging width of the corona charger 2 in the circumferential direction of the photosensitive drum 1 is, for example, about 30 mm. The corona charger 2 is described later in detail (see FIG. 3 to FIG. 6). Next, the photosensitive drum 1 is scanned by exposure to laser light, which is emitted from the exposure device 3 and corresponds to an image signal. In this manner, an electrostatic latent image corresponding to the image signal is formed on the photosensitive drum. The electrostatic latent image on the photosensitive drum is visualized by toner, which is stored in the developing device 4, to become a visible image.

The toner image formed on the photosensitive drum 1 is primarily transferred onto the intermediate transfer belt 8 at a primary transfer portion T1 formed between the photosensitive drum 1 and the primary transfer roller 5, which is arranged across the intermediate transfer belt 8. At this time, a primary transfer bias is applied to the primary transfer roller 5. Toner or the like remaining on the surface of the photosensitive drum 1 after the primary transfer is removed by the cleaning device 6. The abutment nip width between the photosensitive drum 1 and a cleaning blade was set to within a range of from 10 μm to 70 μm. In addition, the average abutment surface pressure was set to within a range of from 0.2 $N/mm^2$ or more to 1.2 $N/mm^2$ or less. As the cleaning blade, a cleaning blade, in which the hardness of an abutment surface that is brought into contact with the photosensitive drum 1 is different from that of an inner portion that is not brought into contact with the photosensitive drum 1, may be used. In this case, a cleaning blade, in which the hardness of the abutment surface that is brought into contact with the photosensitive drum 1 is increased, is preferred.

Such an operation is sequentially performed in the image forming portions for yellow, magenta, cyan, and black so that toner images of four colors are superimposed on one another on the intermediate transfer belt 8. After that, the recording material received in the cassette 22 is conveyed to the secondary transfer portion T2 in synchronization with the timing to form the toner image. Then, a secondary transfer bias is applied to the secondary transfer roller 10 so that the toner images of four colors on the intermediate transfer belt 8 are secondarily transferred in a collective manner onto the recording material.

Next, the recording material is conveyed to the fixing device 21. The fixing device 21 heats and pressurizes the recording material that is being conveyed. With this, the toner on the recording material is melted and mixed so that the toner is fixed onto the recording material as a full-color image. After that, the recording material is delivered to a delivery tray 15, and thus a series of image forming processes is ended.

<Corona Charger>

Figure 6:
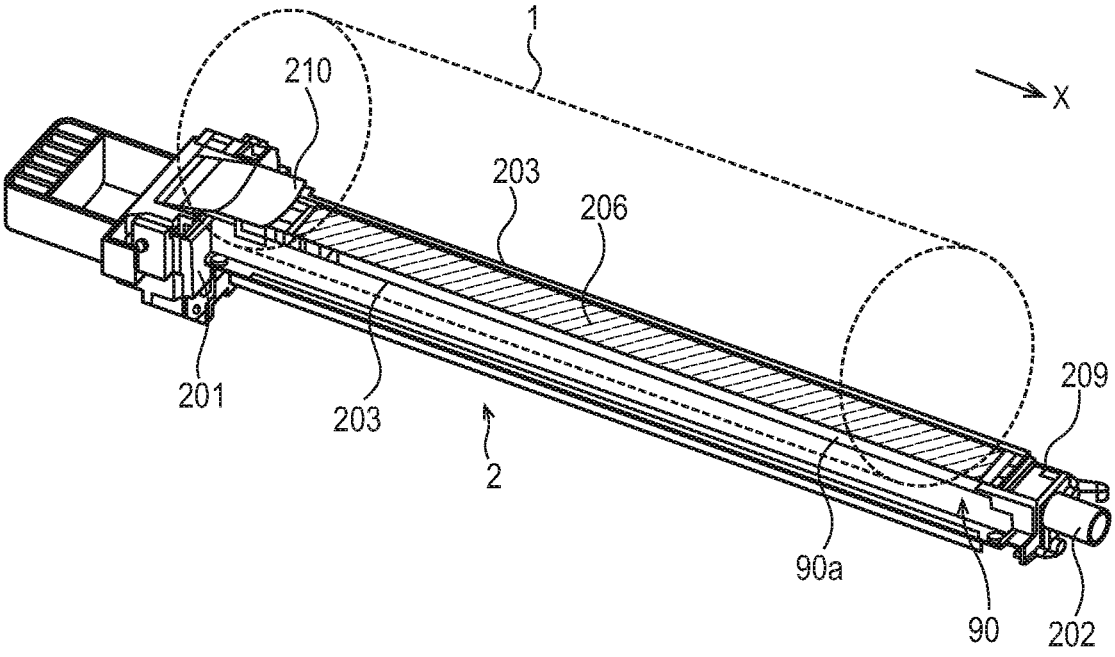
FIG. 6 is an external perspective view for illustrating the corona charger.

The configuration of the corona charger 2 is described with reference to FIG. 6 to FIG. 8B. The corona charger 2 is a scorotron charger, and the corona charger 2 viewed from the photosensitive drum 1 side is illustrated in FIG. 6. The corona charger 2 is arranged so as to be inserted into or removed from the apparatus main body 100A (see FIG. 4) of the image forming apparatus 100, and as illustrated in FIG. 6, the corona charger 2 is arranged at a position opposed to the photosensitive drum 1 along a rotation axis line direction (longitudinal direction) of the photosensitive drum 1.

The corona charger 2 serving as a charging device includes a pair of shield plates 203 serving as shield electrodes, a front block 201 arranged on a front side in an insertion direction (direction indicated by the arrow X in FIG. 6) of the corona charger 2, and a rear block 202 arranged on a rear side in the insertion direction of the corona charger 2.

The corona charger 2 has an airflow passage penetrating through the corona charger 2 from an upper side to a lower side. Ambient air is supplied through the airflow passage to stably cause corona discharge. The pair of shield plates 203 are made of stainless steel (SUS), and are arranged so as to be opposed to each other at a predetermined interval (for example, about 30 mm) in a width direction of a housing 90 (direction orthogonal to the rotation axis line direction, short direction of the photosensitive drum 1). The shield plates 203, the front block 201, and the rear block 202 form the housing 90 that is opened with a cross section having a substantially U-shape. The housing 90 includes an opening portion 90*a* on a side facing the photosensitive drum 1. The front block 201 and the rear block 202 can hold a discharge wire 205 (see FIG. 7) and a grid electrode 206 described later so as to stretch the discharge wire 205 and the grid electrode 206 in the longitudinal direction.

<Discharge Electrode (Discharge Wire)>

Figure 7:
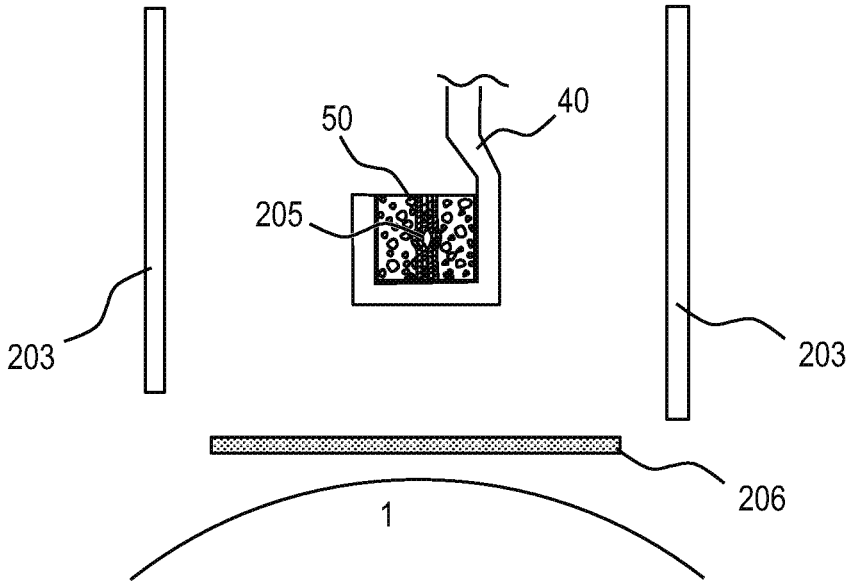
FIG. 7 is a sectional view for illustrating the corona charger.

As illustrated in FIG. 7, the corona charger 2 includes the discharge wire 205 and the grid electrode 206. The discharge wire 205 serving as a discharge electrode is arranged on an inner side of the pair of shield plates 203 (in the housing 90). The discharge wire 205 is supplied with a charging voltage from a high-voltage power source (not shown) to cause corona discharge. The discharge wire 205 is formed in a wire shape through use of, for example, stainless steel, nickel, molybdenum, tungsten, or gold.

As the diameter of the discharge wire 205 is decreased, the discharge wire 205 is more liable to be cut by collision of ions generated in association with discharge. Meanwhile, as the diameter of the discharge wire 205 is increased, it is required to further increase a charging voltage so as to cause stable corona discharge. However, when the charging voltage is excessively increased, ozone is liable to be generated in association with discharge. In view of the foregoing, it is preferred that the discharge wire 205 be formed so as to have a diameter of from 40 μm to 100 μm. As one example, the discharge wire 205 is a tungsten wire formed so as to have a diameter of 60 μm. The discharge electrode is not limited to the discharge wire 205 described above, and a sawtoothed discharge wire, which is formed in an uneven shape in the longitudinal direction, may be used.

<Grid Electrode>

The grid electrode 206 is arranged between the photosensitive drum 1 and the discharge wire 205, and is removably mounted on the housing 90 formed of the front block 201 and the rear block 202 of the corona charger 2 so as to be brought close to the surface of the photosensitive drum 1. The grid electrode 206 is mounted on the housing 90 so as to be stretched in the rotation axis line direction (longitudinal direction) of the photosensitive drum 1 with predetermined tension.

Figure 8A:
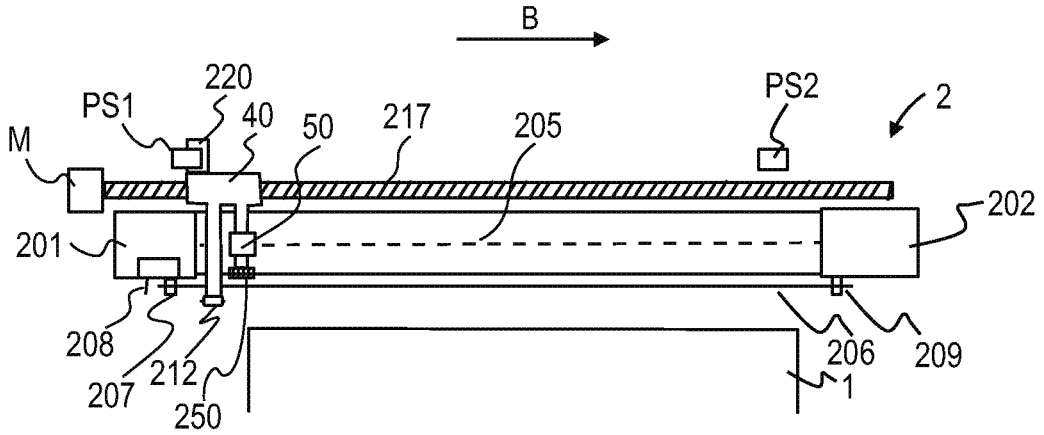
FIG. 8A is a view for illustrating an operation state at a time when the corona charger is viewed from a side.

Specifically, as illustrated in FIG. 8A, the grid electrode 206 is held by a holding portion 207 formed on the front block 201 and a holding portion 209 formed on the rear block 202. The grid electrode 206 is removed from or mounted on the holding portions 207 and 209 in accordance with the operation of a knob 208 by a user. In addition, the knob 208 can adjust the tension for stretching the grid electrode 206 through the holding portions 207 and 209.

The grid electrode 206 can control the amount of a current flowing to the photosensitive drum 1 side in association with the application of a high voltage from the high-voltage power source (not shown). With this, the charge potential of the surface of the photosensitive drum 1 is controlled. When the grid electrode 206 is closer to the surface of the photosensitive drum 1, the effect of uniformly charging the surface of the photosensitive drum 1 is enhanced. In this embodiment, the shortest distance between the grid electrode 206 and the photosensitive drum 1 is set to "1.3±0.3 mm". In addition, the distance between the grid electrode 206 and the discharge wire 205 is set to "8 mm". That is, the discharge wire 205 is arranged so as to have a distance of about 9.3 mm from the photosensitive drum 1.

<Cleaning Member for Discharge Electrode>

In addition, as illustrated in FIG. 7, discharge wire cleaning members 50 (hereinafter sometimes simply referred to as "cleaning members") that are brought into contact with the discharge wire 205 of the corona charger 2 are arranged to the discharge wire 205 by being supported by a cleaning member support member (hereinafter sometimes simply referred to as "support member") 40.

FIG. 7 is an enlarged view for illustrating a state in which two discharge wire cleaning members 50 mounted on the cleaning member support member 40 hold the discharge wire 205 therebetween.

Figure 9:
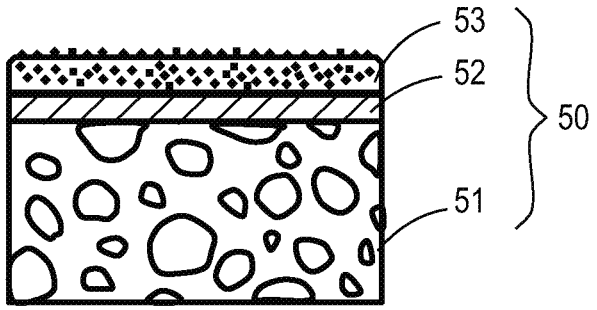
FIG. 9 is a schematic configuration view of a discharge wire cleaning member in this embodiment.
Figure 10:
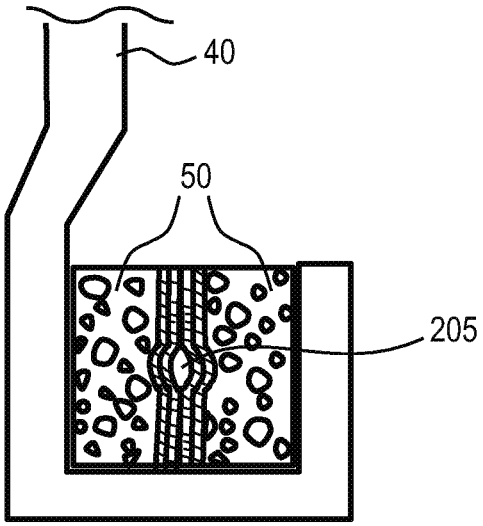
FIG. 10 is a schematic configuration view of the discharge wire cleaning member and a support member in this embodiment.

FIG. 9 is an enlarged view of a cross section of the discharge wire cleaning member 50. The discharge wire cleaning member 50 includes a support layer 51, a wear-resistant layer 52, and an abrasive layer 53. The support layer 51 is a sponge rubber layer having elasticity. The wear-resistant layer 52 is a layer made of a non-woven fabric PET material bonded onto the support layer 51 with a double-sided adhesive tape. The abrasive layer 53 is a layer obtained by solidifying alumina powder with an epoxy-based resin on the wear-resistant layer 52. It is preferred that the support layer 51 having elasticity be made of a material having flame retardancy.

As illustrated in FIG. 7, the abrasive layer 53 of the cleaning member 50 is brought into contact with the discharge wire 205 under a pressure so as to cover the discharge wire 205 through an elastic force of the support layer 51 and the wear-resistant layer 52. When the discharge wire 205 is cleaned by a cleaning operation involving parallelly moving the cleaning member 50 under a state in which the abrasive layer 53 is brought into contact with the discharge wire 205, an adhering substance of the discharge wire 205 is removed and cleaned with the abrasive layer 53. Thus, when particles of silica and strontium titanate adhere to the discharge wire 205, cleaning is performed while the particles of silica and strontium titanate are held on the surface of the abrasive layer 53 by the cleaning operation.

Operation of Cleaning Member for Discharge Electrode>

In this embodiment, immediately after a main switch of the image forming apparatus is turned on, and every time formation of 2,000 sheets of images is performed, the discharge wire cleaning members 50 are reciprocated between the front block 201 and the rear block 202 under a state of holding the discharge wire 205 therebetween. Through such reciprocating operation, contaminants adhering to the surface of the discharge wire 205 are removed by abrasion.

Figure 8B:
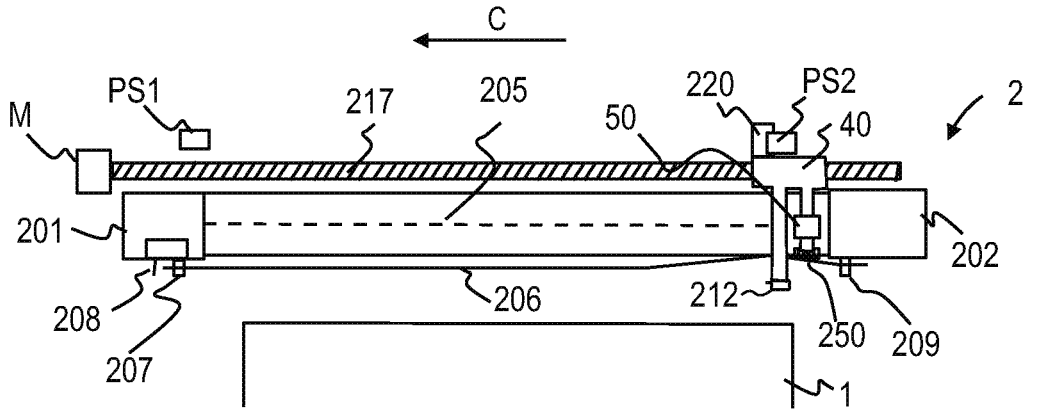
FIG. 8B is a view for illustrating the operation state at a time when the corona charger is viewed from the side.

As described above, the discharge wire cleaning member 50 is supported by the support member 40. As illustrated in FIG. 8A and FIG. 8B, the support member 40 is coupled to a drive screw 217. The drive screw 217 is driven to rotate by a motor M. In association with the rotation (forward rotation) of the drive screw 217, the support member 40 is moved in a direction indicated by the arrow B.

The support member 40 includes a position detection member 220, and the positions of the cleaning member 50 and the support member 40 can be detected by position sensors PS1 and PS2.

As the position sensors PS1 and PS2, it is preferred to use, for example, a photointerrupter sensor in which a light-emitting portion configured to emit light and a light-receiving portion configured to receive light emitted from the light-emitting portion are arranged so as to be opposed to each other.

When the position sensor PS2 detects the position detection member 220 of the support member 40, the drive screw 217 is driven to reversely rotate, and the cleaning member 50 coupled to the support member 40 is moved in a direction indicated by the arrow C.

Through use of the position sensors PS1 and PS2, it can be accurately confirmed how many times the cleaning member 50 has cleaned the discharge wire 205 (how many times the cleaning member 50 has been reciprocated). In addition, the rotation drive of the motor M is controlled before the cleaning member 50 runs into the rear block 202 or the like, and thus the cleaning member 50 can be prevented from running into the rear block 202 or the like.

Further, the support member 40 is coupled also to a cleaning brush 250 configured to clean the grid electrode 206. The cleaning member 50 for the discharge wire 205 and the cleaning brush 250 for the grid electrode 206 are configured to clean the discharge wire 205 and the grid electrode 206, respectively, in association with the movement of the support member 40.

As the cleaning brush 250, a brush, which is obtained by subjecting a brush made of a resin, such as nylon (trademark), polyvinyl chloride (PVC), or a polyphenylene sulfide resin (PPS), to flame retardant treatment and weaving the resultant brush into ground fabric, is used. The cleaning brush 250 is not limited to a brush. For example, a pad formed of felt, sponge, or the like, or a sheet coated with an abrasive, such as alumina or silicon carbide, may be used.

When toner containing strontium titanate particles described later is used, an appropriate amount of the strontium titanate particles also slip through a cleaning blade together with silica particles. A part of the particles having slipped through the cleaning blade adhere to the discharge wire 205 due to the influence of a force in association with the rotation of the photosensitive drum 1, the electric field formed by discharge of the corona discharger 2, the airflow of the corona discharger 2, and the like. The cleaning member 50 is configured to remove contaminants, such as silica, adhering to the discharge wire 205.

The cleaning effects were compared between the case (1) in which only the silica particles adhere to the discharge wire 205 and the case (2) in which the silica particles and a predetermined amount of strontium titanate particles adhere to the discharge wire 205 through use of the cleaning member manufactured by the same formulation. As a result, it was found that the cleaning effect of the cleaning member 50 was improved in the case (2), as compared to the case (1).

The reason for this is considered as follows. The silica particles and the strontium titanate particles adhering to the discharge wire 205 are removed by the cleaning member 50 and held on the abrasive layer 53 of the cleaning member 50. Then, the strontium titanate particles held on the abrasive layer 53 are brought into contact with the adhering substance of the discharge wire 205 together with the abrasive layer 53, and thus the efficiency of removing and cleaning the adhering substance of the discharge wire 205 is enhanced.

In this embodiment, the cleaning member 50 including the abrasive layer 53 is brought into contact with the discharge wire 205. However, even when there is no abrasive layer 53, the cleaning effect is obtained also by bringing sponge having an elastic force or a sheet having an appropriate thickness made of, for example, urethane or polyethylene terephthalate (PET) into direct contact with the discharge wire 205 as long as the characteristics such as foaming formulation and surface roughness of sponge are appropriately controlled. The shape of each of the cleaning members 30 is not limited to such a shape as to hold the discharge electrode therebetween. The cleaning effect is obtained also with a cleaning member having a roller shape, which is brought into contact with the discharge electrode while being rotated. In addition, the cleaning effect brought by the strontium titanate particles is obtained as long as the cleaning member is configured to be brought into contact with and clean the discharge electrode, even when the discharge electrode has a sawtoothed shape instead of the wire shape.

(Toner)

The toner in the present disclosure contains toner particles, and strontium titanate particles and silica particles that are present on surfaces of the toner particles.

(Strontium Titanate Particles)

The present disclosure has a feature in that the number average particle diameter (D1T) of primary particles of the strontium titanate particles present on the surfaces of the toner particles is from 10 nm or more to less than 95 nm.

When the number average particle diameter of the primary particles is 10 nm or more, the strontium titanate particles are finely dispersed effectively on the surfaces of the toner particles, and excessive charging of toner is suppressed. When the number average particle diameter of the primary particles is less than 95 nm, the adhesive force of the strontium titanate particles to the toner particles can be sufficiently obtained, with the result that the rising of charge quantity of toner is accelerated, and the excessive charging of toner can be effectively suppressed. Therefore, even in the case of the use in a high-temperature and high-humidity environment or in a low-temperature and low-humidity environment, sleeve ghost is less liable to occur. Even in the case of the use for a long period of time in a high-temperature and high-humidity environment, toner having satisfactory thin-line reproducibility and dot reproducibility can be provided.

The number average particle diameter of the primary particles of the strontium titanate particles is preferably from 12 nm or more to 45 nm or less, more preferably from 15 nm or more to 40 nm or less. The number average particle diameter of the primary particles of the strontium titanate particles can be controlled by the concentration, reaction temperature, and reaction time of a titanium raw material and a strontium raw material.

In the present disclosure, the average circularity of the strontium titanate particles present on the surfaces of the toner particles is from 0.700 or more to 0.920 or less.

With this, the strontium titanate particles separated from toner in the vicinity of the cleaning blade can slip through the cleaning blade.

The average particle diameter of the primary particles of the strontium titanate particles and the average circularity of the strontium titanate particles falling within the above-mentioned ranges indicate that the strontium titanate particles are smaller in shape than conventional strontium titanate and each have a shape in which corners are rounded. With this, the strontium titanate particles each have such a shape as to easily slip through the cleaning blade as compared to the conventional strontium titanate.

In the third embodiment, the strontium titanate particles and the silica particles having slipped through the cleaning blade reach the vicinity of the discharge electrode due to the force in association with the rotation of the photosensitive member, the airflow and electric field of the corona charger 2 described later, and the like. In the discharge electrode of the corona discharger 2, there is the cleaning member 50 configured to be brought into contact with the discharge electrode to clean the surface of the discharge electrode in order to clean the adhering substance. The cleaning member 50 is configured to physically scrape off the adhering substance of the discharge electrode. In this case, the strontium titanate particles adhere to the cleaning member 50.

The cleaning power of the cleaning member 50 having the strontium titanate particles, which have the above-mentioned number average particle diameter and average circularity, adhering thereto is increased, and the performance of removing the adhering substance, such as silica particles, adhering to the discharge electrode is enhanced. As a result, the contamination of the charging unit is suppressed, and stable image quality can be maintained for a long period of time. The number average particle diameter of the primary particles of the strontium titanate particles can be controlled by the concentration, reaction temperature, and reaction time of a titanium raw material and a strontium raw material.

The present disclosure has a feature in that strontium titanate has a maximum peak (a) at a diffraction angle ($2\theta$) of from 32.00 deg or more to 32.40 deg or less in CuK$\alpha$ characteristic X-ray diffraction, and the maximum peak (a) has a half width of from 0.23 deg or more to 0.50 deg or less. The maximum peak (a) is ascribed to a (1,1,0) plane peak of a crystal of strontium titanate.

The inventors of the present disclosure have made extensive investigations, and as a result, have found that it is extremely important to control the half width to from 0.23 deg or more to 0.50 deg or less.

In general, the half width of the diffraction peak in X-ray diffraction has a relationship with a crystallite diameter of strontium titanate. One particle of the primary particles is formed of a plurality of crystallites, and the crystallite diameter refers to a size of each crystallite forming the primary particle.

The diffraction peak represents an angle at which maximum intensity is obtained in diffraction of a crystal plane. In addition, the half width refers to a width represented by a difference between $\theta 2$ and $\theta 1$ in the case where the maximum intensity of the diffraction peak is represented by P, and the angles on a $2\theta$ axis that takes P/2 are represented by $\theta 1$ and $\theta 2$ ($\theta 2 > \theta 1$). The half width is also called a full width at half maximum. The magnitude of the maximum intensity is required to be determined by subtracting a value of a background.

In the present disclosure, the crystallite refers to each crystal grain forming a particle, and crystallites are aggregated to form a particle. The size of a crystallite has no relationship with a particle diameter. When the crystallite diameter of strontium titanate is small, the half width is increased. When the crystallite diameter of strontium titanate is large, the half width is decreased.

The half width of the diffraction peak in X-ray diffraction of strontium titanate in the present disclosure is from 0.23 deg or more to 0.50 deg or less, which indicates that the crystallite diameter of strontium titanate in the present disclosure is smaller than that of the conventional strontium titanate.

When the crystallite diameter of strontium titanate is decreased, the number of grain boundaries (crystal grain boundaries) between crystallites present in the primary particles is increased. The crystal grain boundary is regarded as a point for trapping charge. Therefore, when the charge quantity of toner is small, the crystal grain boundary is likely to trap charge, and hence the rising of triboelectric charge quantity of toner is accelerated. Meanwhile, the inside of a crystallite of strontium titanate is likely to leak charge of toner. Therefore, it is considered that, when toner is excessively charged to exceed the charge quantity that can be trapped by the crystal grain boundary, the charge passes through the inside of the crystallite, and the excessive charging of the toner can be controlled.

Specifically, when the half width is controlled to from 0.23 deg or more to 0.50 deg or less, the effect of accelerating the rising of charging of toner and suppressing excessive charging of the toner can be obtained. Such effect cannot be obtained in the conventional strontium titanate. As a result, even when images having the same pattern are printed in a large amount, the chargeability of toner in a printing portion and a non-printing portion on a developing sleeve can be uniformly kept. Therefore, it is considered that, even in the case of the use in a high-temperature and high-humidity environment and a low-temperature and low-humidity environment, the effect of suppressing sleeve ghost is remarkably enhanced. In addition, in the third embodiment, it is considered that strontium titanate particles adhere to the cleaning member 50 of the discharge electrode due to such charging characteristics, leading to the effect of increasing the cleaning power of the cleaning member 50.

In addition, when the effect of accelerating the rising of charging of toner on the developing sleeve and suppressing excessive charging becomes satisfactory, the charge quantity distribution of toner becomes narrower. When the charge quantity distribution of toner is broad, particularly in the case of the use in a high-temperature and high-humidity environment for a long period of time, toner having small charge quantity is accumulated in a developing device. As a result, thin-line reproducibility and dot reproducibility are degraded, and the image quality of a fine image may be decreased.

In the present disclosure, the effect of accelerating the rising of charging of toner and suppressing excessive charging is satisfactory. Therefore, the charge quantity distribution of toner becomes narrow, and toner having satisfactory thin-line reproducibility and dot reproducibility even in the case of the use in a high-temperature and high-humidity environment for a long period of time can be provided.

In the present disclosure, it is important that the half width of the diffraction peak in X-ray diffraction of strontium titanate be from 0.23 deg or more to 0.50 deg or less. The half width is preferably from 0.25 deg or more to 0.45 deg or less, more preferably from 0.28 deg or more to 0.40 deg or less. When the half width falls within the above-mentioned range, sleeve ghost is further reduced even in the case of the use in a high-temperature and high-humidity environment and a low-temperature and low-humidity environment. The thin-line reproducibility and dot reproducibility of toner are satisfactory even in the case of the use in a high-temperature and high-humidity environment for a long period of time.

In the present disclosure, it is important that an intensity (Ia) of the maximum peak (a) and a maximum peak intensity (Ix) within a range of a diffraction angle (2θ) of from 24.00 deg or more to 28.00 deg or less in the CuKα characteristic X-ray diffraction satisfy the following expression (1):

$$(Ix)/(Ia) \leq 0.010 \qquad \text{Expression (1)}$$

where (Ix) represents a peak of $SrCO_3$ or $TiO_2$ derived from a raw material for strontium titanate.

The case in which (Ix)/(Ia) does not satisfy the expression (1) means that the purity of strontium titanate is low. For example, when $SrCO_3$ and $TiO_2$ derived from a raw material for strontium titanate remain as impurities, the maximum peak intensities (Ix) of $SrCO_3$ and $TiO_2$ are increased, and the expression (1) is not satisfied. In this case, the impurities are liable to be localized in the crystal grain boundaries, and charge is liable to leak without being trapped by the crystal grain boundaries. Therefore, the rising of charging becomes slow. In addition, in the third embodiment, the effect of increasing the cleaning power of the cleaning member 50 is reduced.

Meanwhile, when the expression (1) is satisfied, the purity of strontium titanate is high, and the amount of the impurities that are localized in the crystal grain boundaries is small. Therefore, charge is likely to be trapped by the crystal grain boundaries, and the rising of charging is accelerated. With this, even in the case of the use in a high-temperature and high-humidity environment, sleeve ghost is less liable to occur. Even in the case of the use in a high-temperature and high-humidity environment for a long period of time, the thin-line reproducibility and dot reproducibility become satisfactory.

It is important that the expression (1) be (Ix)/(Ia)≤0.010, preferably (Ix)/(Ia)≤0.008. It is desired that peaks of (Ix) derived from the impurities be not present.

(Ix)/(Ia) may be controlled by the mixing ratio, reaction temperature, and reaction time of a titanium raw material and a strontium raw material. Further, (Ix)/(Ia) may be controlled by cleaning a strontium titanate slurry with an acid after reaction.

In the present disclosure, regarding strontium titanate, it is important that, when elements detected by fluorescent X-ray analysis are all assumed to be oxides, a total of contents of strontium oxide and titanium oxide with respect to 100% by mass of a total amount of all the oxides be 98.0% by mass or more, The total of contents being less than 98.0% by mass means that impurities other than strontium titanate are present in the crystals in a large amount. When the amount of the impurities is large in the crystals of strontium titanate, the impurities cause strain in the crystals, and through this effect, the half width is increased. In this case, the half width can be increased, but it is difficult to control the crystallite diameter so that the crystallite diameter becomes small. Therefore, the number of crystal grain boundaries is decreased, and charge is liable to leak. As a result, the rising of charging becomes slow.

When the total of contents of strontium oxide and titanium oxide is set to 98.0% by mass or more, the crystallite diameter of strontium titanate particles can be controlled to be small. Therefore, the effect of accelerating the rising of charging and suppressing excessive charging can be made more satisfactory. With this, even in the case of the use in a high-temperature and high-humidity environment and a low-temperature and low-humidity environment, sleeve ghost is less liable to occur. Even in the case of the use in a high-temperature and high-humidity environment for a long period of time, the thin-line reproducibility and dot reproducibility become satisfactory. In addition, in the third embodiment, the cleaning effect of the cleaning member 50 configured to clean the surface of the discharge electrode of the corona charger 2 by being brought into contact with the discharge electrode can be further enhanced.

The total of contents of strontium oxide and titanium oxide is preferably 98.2% by mass or more, and is preferably 100% by mass or less although there is no particular limitation on the upper limit thereof. The contents may be controlled by purifying a titanium raw material to reduce impurities.

(Specific Method of Producing Strontium Titanate)

There is no particular limitation on a method of producing strontium titanate, and strontium titanate is produced, for example, by the following method.

For example, strontium nitrate, strontium chloride, or the like is added to a dispersion liquid of a titania sol that is obtained by adjusting the pH of a water-containing titanium oxide slurry obtained by hydrolyzing an aqueous solution of titanyl sulfate. The mixture is heated to a reaction temperature, and an alkali aqueous solution is added to the resultant, to thereby produce strontium titanate. It is preferred that the reaction temperature be from 60° C. to 100° C.

In order to control the half width of the maximum peak (a), it is preferred that a period of time for adding the alkali aqueous solution be set to 60 minutes or less in the step of adding the alkali aqueous solution. When the adding speed of the alkali aqueous solution is set to 60 minutes or less, particles each having a small crystallite diameter can be obtained. Further, in the step of adding the alkali aqueous solution, it is preferred that the alkali aqueous solution be added under the application of ultrasonic vibration from the viewpoint of controlling the half width. When the ultrasonic vibration is applied in the reaction step, the deposition rate of crystals is increased, and particles each having a small crystallite diameter can be obtained.

In addition, it is preferred that an aqueous solution, which is obtained after the reaction caused by adding the alkali aqueous solution is finished, be rapidly cooled from the viewpoint of controlling the half width. As a method for the rapid cooling, there is given, for example, a method involving adding pure water cooled to 10° C. or less until the temperature reaches a desired temperature. Through the rapid cooling, an increase in crystallite diameter can be suppressed in the cooling step.

Meanwhile, as a method of controlling the half width, a severe processing method (procedure for mechanically applying a strong force to inorganic fine particles) may be used. As severe processing, a method such as ball milling, high pressure torsion, ball drop processing, particle impact, or air-type shot peening may be used.

It is preferred that the strontium titanate particles be subjected to surface treatment as required in order to make the strontium titanate particles hydrophobic and control triboelectric chargeability thereof. Specifically, as the treatment agent, there are given an unmodified silicone varnish, various modified silicone varnishes, an unmodified silicone oil, various modified silicone oils, a silane coupling agent, a silane compound having a functional group, and other organosilicon compounds. Various treatment agents may be used together. Of those, it is particularly preferred that the strontium titanate particles be treated with the silane coupling agent. Specifically, it is preferred that strontium titanate be fine particles subjected to surface treatment with the silane coupling agent.

Examples of the silane coupling agent include vinyltrimethoxysilane, vinyltriethoxysilane, vinyltris(β-methoxyethoxy)silane, epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyl diethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, n-octadecyltrimethoxysilane, trifluoropropyltrimethoxysilane, and hydrolysates thereof.

Of those, n-octyltriethoxysilane, isobutyltrimethoxysilane, and trifluoropropyltrimethoxysilane are preferred, and isobutyltrimethoxysilane is more preferred. In addition, those treatment agents may be used alone or in combination thereof.

The surface of each of strontium titanate particles may be chemically modified by surface treatment, but the crystal structure of the strontium titanate particles is not influenced. Specifically, the surface treatment does not influence the half width of the maximum peak (a) of strontium titanate. Therefore, in the present disclosure, in order to measure impurity elements that influence the crystal structure, fluorescent X-ray measurement of strontium titanate is performed before the surface treatment.

(Silica Particles)

In the present disclosure, the number average particle diameter (D1S) of the primary particles of the silica particles present on the surfaces of the toner particles is set to from 5 nm or more to 300 nm or less.

When the number average particle diameter of the primary particles of the silica particles present on the surfaces of the toner particles is set to 5 nm or more, the scraping effect of strontium titanate in the charging roller 3 in the present disclosure is most exhibited. In addition, when the number average particle diameter of the primary particles of the silica particles present on the surfaces of the toner particles is set to 300 nm or less, the silica particles form a blocking layer on the cleaning blade, and the amount of strontium titanate that slips through the cleaning blade can be controlled.

As the silica particles to be used in the present disclosure, there are given wet silica obtained by a sedimentation method, a sol-gel method, or the like and dry silica obtained by a deflagration method, a fumed method, or the like. It is more preferred that the silica particles be dry silica from the viewpoint of easy control of a shape.

As a raw material for dry silica, a silicon halide compound or the like is used. As the silicon halide compound, silicon tetrachloride is used. However, silanes such as methyltrichlorosilane and trichlorosilane may also be used alone as the raw material, or silicon tetrachloride and silanes in a mixed state may also be used as the raw material.

The raw material is vaporized, and then intended silica is obtained by a so-called flame hydrolysis reaction in which the vaporized raw material reacts with water generated as an intermediate product in oxyhydrogen flame. For example, the flame hydrolysis reaction utilizes a thermal decomposition and oxidation reaction in oxygen and hydrogen of a silicon tetrachloride gas, and the reaction formula is as follows.

$$SiCl_4+2H_2+O_2 \rightarrow SiO_2+4HCl$$

Now, a production example of dry silica to be used in the present disclosure is described.

An oxygen gas was supplied to an ignition burner, and the ignition burner was ignited. After that, a hydrogen gas was supplied to the ignition burner to form flame. Silicon tetrachloride serving as a raw material was loaded into the flame to be gasified. Next, a flame hydrolysis reaction was caused to occur, and generated silica powder was collected. The number average particle diameter and shape of the silica powder may be suitably adjusted by appropriately changing a silica tetrachloride flow rate, an oxygen gas supply flow rate, a hydrogen gas supply flow rate, and a silica retention time in the flame.

As a method of crushing silica particles, for example, a crusher, such as an atomizer (manufactured by Tokyo Atomizer M.F.G. Co., Ltd.), may be used.

It is preferred that the silica particles be subjected to surface treatment in order to make the silica particles hydrophobic and control triboelectric chargeability thereof as required by using various treatment agents alone or in combination thereof. Examples of the treatment agent include an unmodified silicone varnish, various modified silicone varnishes, an unmodified silicone oil, various modified silicone oils, a silane coupling agent, a silane compound having a functional group, and other organosilicon compounds.

It is preferred that the total content of the silica particles be from 8.0 parts by mass or more to 15.0 parts by mass or less with respect to 100 parts by mass of the toner particles. When the total content of the silica particles is set to 8.0 parts by mass or more, the silica particles form the blocking layer on the cleaning blade, and the amount of strontium titanate that slips through the cleaning blade can be controlled. Further, toner fluidity is ensured so as to obtain a delivery property of the toner from a toner bottle. In addition, when the total content of the silica particles is set to 15.0 parts by mass or less, the contamination of the charging roller can be prevented.

(Relationship between Strontium Titanate Particles and Silica Particles)

In the present disclosure, it is required that an amount of the strontium titanate particles separated from the toner when the toner is washed with water have a predetermined magnification with respect to an amount of the silica particles separated from the toner when the toner is washed with water. A method of washing the toner with water is described in detail in the section of a measurement method.

In the first embodiment, the required magnification is 0.2 time or more. When the magnification is set to 0.2 time or more, the scraping effect of the strontium titanate particles in the charging roller is satisfactorily exhibited.

In the second embodiment, the required magnification is from 0.01 time or more to 0.6 time or less. When the magnification is set to 0.01 time or more, the scraping effect of the strontium titanate particles in the charging roller can be ensured. When the magnification is set to 0.6 time or less, flying of the silica particles to the charging roller can be satisfactorily suppressed.

In the third embodiment, the required magnification is from 0.01 time or more to 0.9 time or less. When the magnification falls within this range, the contamination of a charging member can be more satisfactorily suppressed.

It is preferred that the silica particles include first silica particles having a number average particle diameter (D1S1) of from 5 nm or more to 20 nm or less and second silica particles having a number average particle diameter (D1S2) of from 80 nm or more to 120 nm or less, and that the number average particle diameter (D1T) of the strontium titanate particles, the number average particle diameter (D1S1) of the first silica particles, and the number average particle diameter (D1S2) of the second silica particles have a relationship satisfying the following expression (2).

$$D1S2>D1T>D1S1 \quad \text{Expression (2)}$$

The second silica particles each having a large particle diameter as described above mainly contribute to the formation of the blocking layer in the cleaning blade, and hence it is preferred that the second silica particles be larger than the strontium titanate particles. With this, the strontium titanate particles can slip through the cleaning blade. Further, when the first silica particles are smaller than the strontium titanate particles, the scraping effect of the strontium titanate particles in the charging roller is exhibited.

(Toner)

It is preferred that the toner have a median diameter (D50) on a number basis of from 3.0 μm or more to 6.0 μm or less.

The strontium titanate particles to be used in the present disclosure exhibit the effect thereof more satisfactorily in the case where the toner has a small particle diameter and is more likely to slip through the cleaning blade.

In general, the toner particles contain a binder resin and a colorant, and in addition, contain a release agent, a charge control agent, and the like as required.

Examples of the binder resin include a styrene-based resin, a styrene-based copolymer resin, a polyester resin, a polyol resin, a polyvinyl chloride resin, a phenol resin, a natural resin-modified phenol resin, a natural resin-modified maleic acid resin, an acrylic resin, a methacrylic resin, polyvinyl acetate, a silicone resin, a polyurethane resin, a polyamide resin, a furan resin, an epoxy resin, a xylene resin, polyvinyl butyral, a terpene resin, a coumarone-indene resin, and a petroleum-based resin. As a resin to be preferably used, there are given, for example, a styrene-based copolymer resin, a polyester resin, and a hybrid resin formed by mixing a polyester resin and a styrene-based copolymer resin or subjecting the resins to partial reaction with each other. A mode including a polyester resin as the binder resin is more preferred.

The release agent (wax) may be used for imparting releaseability to the toner.

Examples of the wax include: aliphatic hydrocarbon-based waxes, such as low-molecular weight polyethylene, low-molecular weight polypropylene, an olefin copolymer, a microcrystalline wax, a paraffin wax, and a Fischer-Tropsch wax; oxidized waxes of aliphatic hydrocarbon-based waxes, such as a polyethylene oxide wax; waxes each containing a fatty acid ester as a main component, such as a carnauba wax, behenyl behenate, and a montanic acid ester wax; and waxes each obtained by partly or wholly deoxidizing a fatty acid ester, such as a deoxidized carnauba wax.

Examples thereof also include: saturated linear fatty acids, such as palmitic acid, stearic acid, and montanic acid; unsaturated fatty acids, such as brassidic acid, eleostearic acid, and parinaric acid; saturated alcohols, such as stearyl alcohol, aralkyl alcohol, behenyl alcohol, carnaubyl alcohol, ceryl alcohol, and melissyl alcohol; polyhydric alcohols, such as sorbitol; fatty acid amides, such as linoleamide, oleamide, and lauramide; saturated fatty acid bisamides, such as methylenebisstearamide, ethylenebiscapramide, ethylenebislauramide, and hexamethylenebisstearamide; unsaturated fatty acid amides, such as ethylenebisoleamide, hexamethylenebisoleamide, N,N'-dioleyladipamide, and N,N'-dioleylsebacamide; aromatic bisamides, such as m-xylenebisstearamide and N,N'-distearylisophthalamide; fatty acid metal salts, such as calcium stearate, calcium laurate, zinc stearate, and magnesium stearate (generally referred to as metal soap); waxes each obtained by grafting an aliphatic hydrocarbon-based wax with a vinyl-based copolymerizable monomer, such as styrene or acrylic acid; partially esterified products each formed of a fatty acid and a polyhydric alcohol, such as behenic acid monoglyceride; and methyl ester compounds each having a hydroxyl group obtained by subjecting a vegetable oil and fat to hydrogenation.

The wax that is particularly preferably used in the present disclosure is an aliphatic hydrocarbon-based wax. Preferred examples of the wax include: a low-molecular-weight hydrocarbon obtained by subjecting an alkylene to radical polymerization under high pressure or polymerizing an alkylene with a Ziegler catalyst or a metallocene catalyst under low pressure; a Fischer-Tropsch wax synthesized from coal or a natural gas; an olefin polymer obtained by thermally decomposing a high-molecular-weight olefin polymer; a synthetic hydrocarbon wax that is obtained from a distillation residue of a hydrocarbon obtained from a synthetic gas containing carbon monoxide and hydrogen by the Arge method, and a synthetic hydrocarbon wax obtained by subjecting the foregoing to hydrogenation.

Further, a hydrocarbon wax fractionated by a press sweating method, a solvent method, a vacuum distillation method, or a fractional crystallization method is more preferably used. In particular, a wax synthesized by a method that does not use polymerization of an alkylene is preferred from the viewpoint of the molecular weight distribution thereof.

The wax may be added at a time of production of toner or at a time of production of a binder resin. In addition, those waxes may be used alone or in combination thereof. It is preferred that the wax be added in an amount of from 1 part by mass or more to 20 parts by mass or less with respect to 100 parts by mass of the binder resin.

The toner in at least one embodiment of the present disclosure may be used as any of magnetic one-component toner, non-magnetic one-component toner, and non-magnetic two-component toner.

When the toner in at least one embodiment of the present disclosure is used as the magnetic one-component toner, magnetic iron oxide particles are preferably used as a colorant. As the magnetic iron oxide particles contained in the magnetic one-component toner, there are given magnetic iron oxides such as magnetite, maghemite, and ferrite, magnetic iron oxides including other metal oxides, metals such as Fe, Co, and Ni, alloys of those metals and metals such as Al, Co, Cu, Pb, Mg, Ni, Sn, Zn, Sb, Be, Bi, Cd, Ca, Mn, Se, Ti, W, and V, and mixtures thereof. It is preferred that the content of the magnetic iron oxide particles be from 30 parts by mass or more to 100 parts by mass or less with respect to 100 parts by mass of the binder resin.

As the colorant in the case where the toner in at least one embodiment of the present disclosure is used as the non-magnetic one-component toner and the non-magnetic two-component toner, there are given the following.

As a black pigment, carbon black, such as furnace black, channel black, acetylene black, thermal black, or lamp black, is used, and in addition, magnetic powder, such as magnetite or ferrite, is also used.

As a colorant suitable for yellow color, a pigment or a dye may be used. Examples of the pigment include: C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191; and C.I. Vat Yellow 1, 3, and 20. Examples of the dye include C.I. Solvent Yellow 19, 44, 77, 79, 81, 82, 93, 98, 103, 104, 112, and 162. Those colorants may be used alone or in combination thereof.

As a colorant suitable for cyan color, a pigment or a dye may be used. Examples of the pigment include: C.I. Pigment Blue 1, 7, 15, 15:1, 15:2, 15:3, 15:4, 16, 17, 60, 62, and 66; C.I. Vat Blue 6; and C.I. Acid Blue 45. Examples of the dye include C.I. Solvent Blue 25, 36, 60, 70, 93, and 95. Those colorants may be used alone or in combination thereof.

As a colorant suitable for magenta color, a pigment or a dye may be used. Examples of the pigment include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, and 254; C.I. Pigment Violet 19; and C.I. Vat Red 1, 2, 10, 13, 15, 23, 29, and 35.

Examples of the dye for magenta include: oil-soluble dyes, such as: C.I. Solvent Red 1, 3, 8, 23, 24, 25, 27, 30, 49, 52, 58, 63, 81, 82, 83, 84, 100, 109, 111, 121, and 122; C.I. Disperse Red 9; and C.I. Solvent Violet 8, 13, 14, 21, and 27; and C.I. Disperse Violet 1; and basic dyes, such as: C.I. Basic Red 1, 2, 9, 12, 13, 14, 15, 17, 18, 22, 23, 24, 27, 29, 32, 34, 35, 36, 37, 38, 39, and 40; and C.I. Basic Violet 1, 3, 7, 10, 14, 15, 21, 25, 26, 27, and 28. Those colorants may be used alone or in combination thereof.

It is preferred that the content of the colorant be from 1 part by mass or more to 20 parts by mass or less with respect to 100 parts by mass of the binder resin.

A charge control agent may be used in the toner. As the charge control agent, a known agent may be used, and there are given, for example, an azo-based iron compound, an azo-based chromium compound, an azo-based manganese compound, an azo-based cobalt compound, an azo-based zirconium compound, a chromium compound of a carboxylic acid derivative, a zinc compound of a carboxylic acid derivative, an aluminum compound of a carboxylic acid derivative, and a zirconium compound of a carboxylic acid derivative.

It is preferred that the carboxylic acid derivative be an aromatic hydroxycarboxylic acid. In addition, a charge control resin may also be used. When the charge control agent or the charge control resin is used, it is preferred that the charge control agent or the charge control resin be used in an amount of from 0.1 part by mass or more to 10 parts by mass or less with respect to 100 parts by mass of the binder resin.

(Method of Producing Toner)

There is no particular limitation on a method of producing toner except for including the step of causing strontium titanate particles and silica particles to stick to the surfaces of toner particles by treatment using hot air or the like, and a production method that has hitherto been known may be used.

Here, a procedure for producing toner through use of a pulverization method is described.

In a raw material-mixing step, predetermined amounts of, for example, the binder resin, the colorant, and the wax, and as required, any other component, such as the charge control agent, as materials forming the toner particles are weighed, and the materials are blended and mixed. A mixing apparatus is, for example, a double cone mixer, a V-type mixer, a drum-type mixer, a super mixer, a Henschel mixer, a Nauta mixer, or MECHANO HYBRID (manufactured by Nippon Coke & Engineering Co., Ltd.).

Next, the mixed materials are melt-kneaded to disperse the wax and the like in the binder resin. In the melt-kneading step, a batch-type kneader, such as a pressure kneader or a Banbury mixer, or a continuous kneader may be used, and a single-screw or twin-screw extruder has been in the mainstream because of the following superiority: the extruder can perform continuous production. Examples of the extruder include a KTK-type twin-screw extruder (manufactured by Kobe Steel, Ltd.), a TEM-type twin-screw extruder (manufactured by Toshiba Machine Co., Ltd.), a PCM kneader (manufactured by Ikegai Corp), a twin-screw extruder (manufactured by K.C.K.), a co-kneader (manufactured by Buss), and KNEADEX (manufactured by Nippon Coke & Engineering Co., Ltd.).

Further, the resin composition obtained by the melt-kneading may be rolled with a twin-roll mill or the like, and may be cooled with water or the like in a cooling step.

Next, the cooled resin composition is pulverized in a pulverization step until a desired particle diameter is attained. In the pulverization step, the composition is coarsely pulverized with, for example, a pulverizer, such as a crusher, a hammer mill, or a feather mill, and then finely pulverized with, for example, Kryptron System (manufactured by Kawasaki Heavy Industries, Ltd.), SUPER ROTOR (manufactured by Nisshin Engineering Inc.), Turbo Mill (manufactured by Freund-Turbo Corporation), or a fine pulverizer using an air jet system.

After that, the resultant is subjected to classification with a classifier or sieving machine, such as Elbow-Jet of an inertial classification system (manufactured by Nittetsu Mining Co., Ltd.), Turboplex of a centrifugal classification system (manufactured by Hosokawa Micron Corporation), TSP Separator (manufactured by Hosokawa Micron Corporation), or Faculty (manufactured by Hosokawa Micron) as required. Thus, base particles are obtained.

An adhesion step of causing strontium titanate particles and silica particles to adhere to the surfaces of the base particles thus obtained is performed, and after that, the resultant is subjected to surface treatment through use of hot air. Then, the resultant is classified through use of a classifier or a sieving machine as required, and thus toner particles in which the strontium titanate particles and the silica particles stick to the surfaces can be obtained.

There is no particular limitation on a method of causing the strontium titanate particles and the silica particles to adhere to the surfaces of the base particles in the adhesion step, and the base particles, the strontium titanate particles, and the silica particles are weighed in predetermined amounts to be blended and mixed.

In addition, other inorganic fine particles, charge control agents, fluidity imparting agents, and the like may also be simultaneously blended within a range not impairing the effect of the present disclosure.

A mixing apparatus is, for example, a double cone mixer, a V-type mixer, a drum-type mixer, a super mixer, a Henschel mixer, or a Nauta mixer, and each mixer is preferably used.

The Henschel mixer is more preferably used as the mixing apparatus from the viewpoint of causing the strontium titanate particles and the silica particles to more uniformly adhere to the surfaces of the base particles.

As the mixing condition, it is preferred that the number of rotation of a mixing blade be higher, and the mixing time be longer. This is because the strontium titanate particles and the silica particles can be easily caused to uniformly adhere to the surfaces of the base particles. However, when the number of rotation of the mixing blade is excessively high, and the mixing time is excessively long, the friction heat between the toner and the mixing blade becomes high, with the result that the toner is increased in temperature to be fused to the mixing blade.

Thus, it is preferred that the mixing apparatus be actively cooled, for example, by providing a water-cooling jacket to the mixing blade and the mixing apparatus.

It is preferred that the number of rotation of the mixing blade and the mixing time be adjusted to within such a range that the temperature in the mixing apparatus reaches 45° C. or less. Specifically, the maximum peripheral speed of the mixing blade is preferably from 10.0 m/sec or more to 150.0 m/sec or less, and the mixing time is preferably adjusted to within a range of from 0.5 minute to 60 minutes.

In addition, the adhesion step may be performed in one stage or a multistage of two or more stages, and the mixing apparatus, the mixing condition, blending of the base particles, and the like used in each stage may be the same or different.

In the present disclosure, as an apparatus to be used in the treatment using hot air, any apparatus may be used as long as the apparatus includes a unit configured to bring the surfaces of the toner particles before the treatment into a melted state through use of hot air and includes a unit capable of cooling the toner particles, which are treated through use of hot air, with cold air.

As such apparatus, there may be given, for example, Meteo Rainbow MR Type (manufactured by Nippon Pneumatic Mfg., Co., Ltd.).

Next, one embodiment of a method for surface treatment using hot air is described with reference to FIG. 3, but the present disclosure is not limited thereto.

In the present disclosure, particles having the strontium titanate particles and the silica particles sticking to the surfaces thereof, which are obtained by subjecting the base particles having the strontium titanate particles and the silica particles adhering to the surfaces thereof to surface treatment through use of hot air, are referred to as "toner particles". In the description in this specification, for convenience, particles before having the strontium titanate particles and the silica particles sticking to the surfaces thereof are sometimes referred to as "toner particles".

Figure 3:
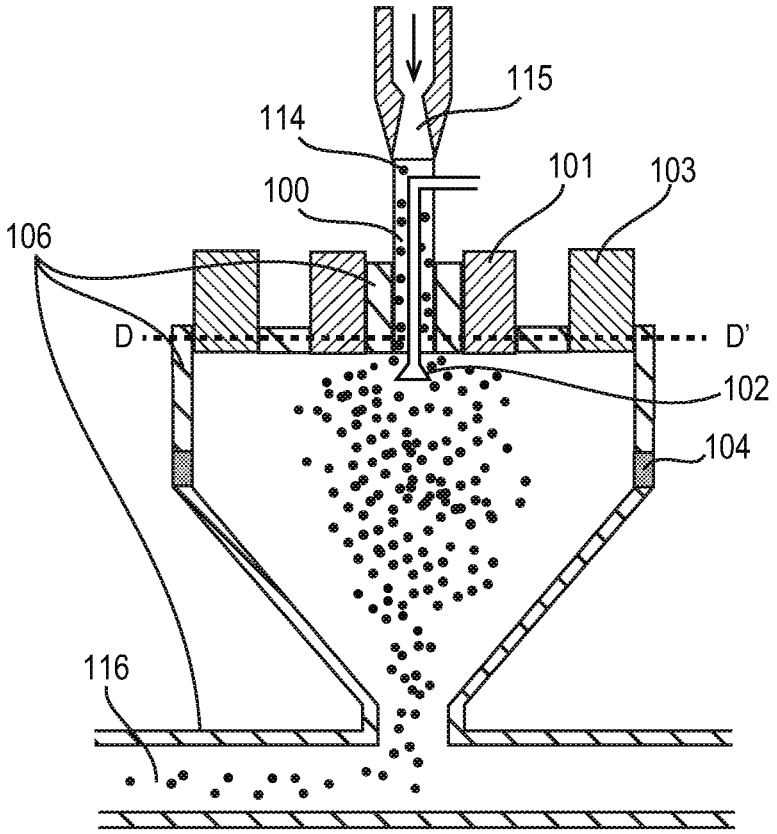
FIG. 3 is a view for illustrating one embodiment of a method for toner surface treatment.

FIG. 3 is an exemplary sectional view of a surface treatment apparatus used in the present disclosure. As a method for surface treatment, specifically, base particles having the strontium titanate particles and the silica particles adhering to the surfaces thereof in advance are used as a raw material, and the raw material is supplied to the surface treatment apparatus.

Toner particles 114 supplied from a toner particle supply port 100 are accelerated with injection air jetted from a high-pressure air supply nozzle 115 and move towards an airstream jetting member 102 arranged below the high-pressure air supply nozzle 115.

Diffusion air is jetted from the airstream jetting member 102, and toner particles are diffused in an outside direction by the diffusion air. In this case, the diffusion state of the toner particles may be controlled by regulating the flow rate of the injection air and the flow rate of the diffusion air.

In addition, in order to prevent fusion of the toner particles, a cooling jacket 106 is provided on each outer periphery of the toner particle supply port 100, the surface treatment apparatus, and a transfer pipe 116.

It is preferred that cooling water (preferably antifreeze liquid, such as ethylene glycol) be caused to pass through the cooling jacket.

Meanwhile, the toner particles diffused by the diffusion air are subjected to surface treatment with hot air supplied from a hot air supply port 101.

In this case, the discharge temperature of the hot air is preferably from 100° C. or more to 300° C. or less, more preferably from 150° C. or more to 250° C. or less.

When the temperature of the hot air is less than 100° C., the molten state of the toner particles becomes insufficient, and the strontium titanate particles and the silica particles are not sufficiently buried in the surfaces of the toner particles, with the result that the strontium titanate particles and the silica particles may not be caused to stick to the surfaces of the toner particles.

When the temperature of the hot air is more than 300° C., the molten state of the toner particles excessively proceeds. Therefore, the degree at which the strontium titanate particles and the silica particles are buried in the surfaces of the toner particles may become non-uniform, or the strontium titanate particles and the silica particles may be completely buried in the toner particles. As a result, the fluidity and chargeability of the toner to be obtained may deteriorate. In addition, the toner particles are liable to coalesce in the production process, with the result that the toner particles may be coarsened and fused to an inner wall surface of the apparatus in a large amount.

Further, the average circularity of the toner to be obtained may be controlled to from 0.955 or more to 0.980 or less by adjusting the discharge temperature of the hot air within the above-mentioned temperature range.

As the toner particles are treated at higher temperature, the average circularity of the toner to be obtained becomes higher. When the toner particles are treated at lower temperature, the average circularity of the toner to be obtained becomes lower. Therefore, as the quantity of heat applied to the toner particles is larger, the average circularity of the toner tends to be increased.

In view of the foregoing, it is considered that, depending on the average circularity of the toner, the degree at which the strontium titanate particles and the silica particles are buried in the surfaces of the toner particles is varied. However, the number average particle diameters of the primary particles of the strontium titanate particles and the silica particles to be used in the present disclosure fall within particular ranges. Therefore, the strontium titanate particles and the silica particles are appropriately buried in the surfaces of the toner particles with the average circularity of the toner falling within the above-mentioned range, and the sticking strength thereof is also high. Thus, the strontium titanate particles and the silica particles to be used in the present disclosure are preferred.

The toner articles subjected to surface treatment with the hot air are cooled with cold air supplied from a first cold air supply port 103 formed on an outer periphery of the hot air supply port 101 in an upper portion of the apparatus. In this case, in order to control the temperature distribution in the apparatus and control the surface state of the toner particles, it is preferred that cold air from a second cold air supply port 104 formed in a main body side surface of the apparatus be introduced. An outlet of the second cold air supply port 104 may be formed into a slit shape, a louver shape, a porous plate shape, or a mesh shape. As an introduction direction, a horizontal direction towards the center, a direction along a wall surface of the apparatus, or the like may be selected in accordance with the purpose.

In this case, the temperature of the cold air is preferably from −50° C. or more to 10° C. or less, more preferably from −40° C. or more to 8° C. or less. In addition, it is preferred that the cold air be dehumidified air. Specifically, the absolute moisture amount in the cold air is preferably 5 g/m$^3$ or less, more preferably 3 g/m$^3$ or less.

When the temperature of the cold air is less than −50° C., the temperature in the apparatus is excessively decreased, and the treatment with heat, which is the original purpose, cannot be performed sufficiently, with the result that the surfaces of the toner particles may not be brought into a molten state.

In addition, when the temperature of the cold air is more than 10° C., the toner particles subjected to surface treatment with the hot air cannot be sufficiently cooled, with the result that coarsening and fusion of the toner particles caused by coalescence thereof may occur.

After that, the cooled toner particles are sucked by a blower and collected by a cyclone or the like through the transfer pipe 116.

After the toner particles are subjected to surface treatment with the hot air, the toner particles are classified through use of a classifier or a sieving machine as required. Thus, toner particles having the strontium titanate particles and the silica particles sticking to the surfaces thereof can be obtained.

It is preferred that at least one of the silica particles and the titanium oxide particles each having a number average particle diameter of primary particles of from 5 nm or more to 50 nm or less be further externally added to the toner in at least one embodiment of the present disclosure in any of stages after the surface treatment with the hot air is performed. This is because the fluidity of the toner can be further improved.

(Carrier)

The toner may be mixed with carriers so as to be used as a two-component developer. As the carriers, general carriers, such as ferrite and magnetite, and resin-coated carriers may be used. In addition, a binder-type carrier core in which magnetic powder is dispersed in a resin may also be used.

The resin-coated carriers include carrier core particles and a coating material that is a resin for coating the surfaces of the carrier core particles. Examples of the resin to be used as the coating material include: styrene-acrylic resins, such as a styrene-acrylic acid ester copolymer and a styrene-methacrylic acid ester copolymer; acrylic resins, such as an acrylic acid ester copolymer and a methacrylic acid ester copolymer; fluorine-containing resins, such as polytetrafluoroethylene, a monochlorotrifluoroethylene polymer, and polyvinylidene fluoride; a silicone resin; a polyester resin; a polyamide resin; polyvinyl butyral; and an aminoacrylate resin. Examples thereof also include an ionomer resin and a polyphenylene sulfide resin. Those resins may be used alone or in combination thereof.

Next, a measurement method for each physical property in the present disclosure is described.

<Calculation Method for Average Circularity>

The average circularity is measured under measurement and analysis conditions at a time of a calibration operation with a flow-type particle image analyzer "FPIA-3000" (manufactured by Sysmex Corporation).

The measurement principle of the flow-type particle image analyzer "FPIA-3000" (manufactured by Sysmex Corporation) is to take images of flowing particles as still images to perform image analysis. A sample loaded to a sample chamber is fed to a flat sheath flow cell with a sample suction syringe. The sample fed to the flat sheath flow cell is held by a sheath liquid to form a flat flow. The sample passing through the flat sheath flow cell is irradiated with stroboscopic light at intervals of 1/60 seconds, and thus the images of the flowing particles can be taken as still images.

In addition, the flowing particles form a flat flow and hence the images are taken in a focused state. Each particle image is taken with a CCD camera, and the image thus taken is subjected to image processing at an image processing resolution (0.37 μm×0.37 μm per pixel) of 512 pixels×512 pixels. A contour of each particle image is extracted, and a projection area S, a perimeter L, and the like of the particle image are measured.

Next, a circle-equivalent diameter and a circularity are determined through use of the projection area S and the perimeter L. The circle-equivalent diameter refers to a diameter of a circle having the same area as the projection area of the particle image. A circularity C is defined as a value obtained by dividing the perimeter of the circle determined based on the circle-equivalent diameter by the perimeter of the particle projection image and calculated by the following expression.

$$\text{Circularity } C=2\times(\pi\times S)^{1/2}/L$$

The circularity is 1.000 when the particle image is a circle. As the degree of unevenness of an outer periphery of the particle image is increased, the circularity has a smaller value. The circularity of each particle is calculated, and then the range of the circularity of from 0.200 to 1.000 is divided by 800. An arithmetic mean value of the obtained circularities is calculated, and the obtained value is used as an average circularity.

A specific measurement method is as described below.

First, 20 mL of ion-exchanged water from which an impure solid and the like have been removed in advance is charged into a glass vessel. About 0.2 mL of a diluted solution prepared by diluting "Contaminon N" (a 10% by mass aqueous solution of a neutral detergent for washing a precision measuring unit containing a nonionic surfactant, an anionic surfactant, and an organic builder and having a pH of 7, manufactured by Wako Pure Chemical Industries, Ltd.) with ion-exchanged water by three mass fold is added as a dispersant to the vessel. Further, 0.02 g of a measurement sample is added to the vessel, and then the mixture is subjected to dispersion treatment with an ultrasonic dispersing unit for 2 minutes so that a dispersion liquid for measurement may be obtained. At that time, the dispersion liquid is appropriately cooled so as to have a temperature of from 10° C. or more to 40° C. or less. A desktop ultrasonic cleaning and dispersing unit having an oscillatory frequency of 50 kHz and an electrical output of 150 W (e.g., "VS-150" (manufactured by VELVO-CLEAR)) is used as the ultrasonic dispersing unit. A predetermined amount of ion-exchanged water is charged into a water tank, and 2 mL of the Contaminon N is added to the water tank.

The flow-type particle image analyzer provided with a regular objective lens (magnification: 10) is used in the measurement, and a particle sheath "PSE-900A" (manufactured by Sysmex Corporation) is used as a sheath liquid. The dispersion liquid prepared in accordance with the procedure is introduced into the flow-type particle image analyzer, and 3,000 toner particles are subjected to measurement according to the total count mode of an HPF measurement mode (high magnification imaging mode). Then, the average circularity of the particles is determined with a binarization threshold at the time of particle analysis set to 85% and particle diameters to be analyzed limited to ones each corresponding to a circle-equivalent diameter of from 1.985 μm or more to less than 39.69 μm.

In the measurement, automatic focusing is performed with standard latex particles (obtained by diluting, for example, "RESEARCH AND TEST PARTICLES Latex Microsphere Suspensions 5200A" manufactured by Duke Scientific with ion-exchanged water) prior to the initiation of the measurement. After that, focusing is preferably performed every two hours from the initiation of the measurement.

In Examples described below, a flow-type particle image analyzer which has been subjected to a calibration operation by Sysmex Corporation and has received a calibration certificate issued by Sysmex Corporation is used. The measurement is performed under measurement and analysis conditions identical to those at the time of the reception of the calibration certificate except that particle diameters to be analyzed are limited to ones each corresponding to a circle-equivalent diameter of from 1.985 μm or more to less than 39.69 μm.

<X-Ray Diffraction Measurement>

X-ray diffraction measurement is performed under the following conditions through use of MiniFlex 600 (manufactured by Rigaku Corporation).

A measurement sample is placed on a non-reflective sample plate (manufactured by Rigaku Corporation) having no diffraction peak within a measurement range while inorganic fine particles (strontium titanate) are lightly pressed so as to be flat as powder. When the measurement sample becomes flat, the measurement sample is set to an apparatus together with the non-reflective sample plate.

[X-ray Diffraction Measurement Conditions]

Tube bulb: Cu
Collimated beam optical system
Voltage: 40 kV
Current: 15 mA
Start angle: 3°
Stop angle: 60°
Sampling width: 0.02°
Scan speed: 10.00°/min
Divergence slit: 0.625 deg
Scattering slit: 8.0 mm
Light receiving slit: 13.0 mm (Open)

A half width and a peak intensity of the obtained X-ray diffraction peak are calculated through use of analysis software "PDXL" manufactured by Rigaku Corporation.

<Fluorescent X-Ray Measurement>

The fluorescent X-ray measurement of the strontium titanate particles or the inorganic fine particles is performed after a surface treatment agent is removed by solvent cleaning when the surface treatment is performed through use of a silane coupling agent or the like. When particles before the treatment are available, measurement may also be performed through use of the particles before the treatment.

Elements of Na to U in the inorganic fine particles are directly measured under a He atmosphere through use of a wavelength dispersion-type fluorescent X-ray analyzer "Axios advanced" (manufactured by Spectris Co., Ltd.). A polypropylene (PP) film is attached to a bottom surface of a liquid sample cup included in the apparatus. A sufficient amount of a sample is placed in the liquid sample cup to form a layer having a uniform thickness on the bottom surface, and the liquid sample cup is closed with a lid. Measurement is performed under the condition of an output of 2.4 kW. A fundamental parameter (FP) method is used for analysis. In this case, all the detected elements are assumed to be oxides, and the total mass thereof is set to 100% by mass. Contents (% by mass) of strontium oxide (SrO) and titanium oxide ($TiO_2$) with respect to the total mass is determined as an oxide conversion value through use of software UniQuani5 (Ver. 5.49) (manufactured by Spectris Co., Ltd.).

<Measurement Method for Number Average Particle Diameter (D1) of Primary Particles of Inorganic Fine Particles>

The number average particle diameter of primary particles of an external additive is measured through use of a transmission electron microscope (TEM) "JEM2800" (manufactured by JEOL Ltd.).

First, a measurement sample is adjusted. 1 mL of isopropanol is added to about 5 mg of an external additive, and the external additive is dispersed with an ultrasonic disperser (ultrasonic cleaner) for 5 minutes. Next, one drop of the dispersion liquid is applied to a microgrid (150 mesh) having a support film for the TEM and dried to prepare a measurement sample.

Next, an image is acquired with a magnification (for example, from 200 k times to 1 M times) at which the external additive in the field of view can be sufficiently measured for length under the condition of an accelerating voltage of 200 kV with the transmission electron microscope (TEM), and the particle diameters of randomly selected 100 primary particles of the external additive are measured to determine a number average particle diameter. The particle diameters of the primary particles may be measured manually or through use of a measurement tool.

<Measurement of Particle Diameters of Primary Particles of Inorganic Fine Particles on Toner Surfaces>

The particle diameters of the primary particles of the inorganic fine particles on the toner surfaces were determined by observing the inorganic fine particles on the toner through use of a scanning electron microscope (SEM) "S-4700" (manufactured by Hitachi, Ltd.).

The observation magnification was appropriately adjusted in accordance with the size of each of organic and inorganic composite fine particles. In the field of view magnified by up to 200,000 times, long diameters of 100 primary particles were measured, and an average value thereof was defined as a number average particle diameter.

<Measurement of Median Diameter (D50) on Number Basis of Toner>

The median diameter (D50) on a number basis of toner in the present disclosure may be determined by observing a secondary electronic image with the scanning electron microscope and subsequently performing image processing.

The median diameter (D50) on a number basis of toner in the present disclosure was measured through use of a scanning electron microscope (SEM) "S-4800" (manufactured by Hitachi, Ltd.).

Specifically, toner was fixed onto a sample stage for electron microscope observation with a carbon tape so that the toner formed one layer, and the toner was subjected to vapor deposition of platinum thereon. The resultant was observed with the scanning electron microscope (SEM) "S-4800" (manufactured by Hitachi, Ltd.) under the following conditions. Observation was performed after a flushing operation was performed.

Signal name=SE (U, LA80)
Accelerating voltage=2,000 Volt
Emission current=10,000 nA
Working distance=6,000 um
Lens mode=High
Condenser 1=5
Scan speed=Slow 4 (40 sec)
Magnification=50,000
Data size=1,280×960
Color mode=Grayscale As a secondary electron image, a toner projection image was obtained by adjusting the luminance to 'Contrast-5 and Brightness-5', setting a capture speed/integrated number of sheets to 'Slow-4 for 40 seconds', and setting 8-bit 256 grayscale images of an image size of 1,280 pixels×960 pixels on control software of the scanning electron microscope S-4800. From a scale on the image, the length of one pixel is 0.02 μm, and the area of one pixel is 0.0004 $\mu m^2$.

Subsequently, 100 particles of the toner were each calculated for a projection area circle-equivalent diameter through use of the obtained projection image based on the secondary electronic image. A method of selecting 100 particles of the toner to be analyzed is described later in detail.

Next, a portion of a toner particle group was extracted, and the size of one particle of the extracted toner was counted. Specifically, first, in order to extract a toner particle group to be analyzed, the toner particle group and a background portion were separated from each other. "Measure"-"Count/Size" in Image-Pro Plus 5.1J was selected. A brightness range was set to within a range of from 50 to 255 in "Brightness Range Selection" of "Count/Size". The carbon tape portion having low brightness projected as a background was excluded to extract the toner particle group. When the toner particle group is fixed by a method other than a method using the carbon tape, there still remains a possibility that the background does not always become a region having low brightness or the background partially has brightness similar to that of the toner particle group. However, a boundary between the toner particle group and the background can be easily recognized based on the secondary electronic observation image. When extraction was performed, in an extraction option of "Count/Size": "4-Connect" was selected; 5 was input in "Smoothing"; and "Fill Holes" was marked. Toner particles positioned on all the boundaries (outer peripheries) of the image and the toner particles overlapped with other toner particles were excluded from calculation. Next, in a measure menu of the "Count/Size", an area and a Feret diameter (mean) were selected, and a selection range of an area was set to a minimum of 100 pixels and a maximum of 10,000 pixels. Thus, each toner particle to be subjected to image analysis was extracted. One particle of the toner was selected from the extracted toner particle group, and the size (number of pixels: ja) of a portion derived from the particle was determined. A projection area circle-equivalent diameter "$d_1$"

was obtained through use of the following expression based on the obtained ja.

$$d_1=\{(4\times ja\times 0.3088)/3.14\}^{1/2}$$

Next, in the "Brightness Range Selection" of the "Count/Size" in Image-Pro Plus 5.1J, the brightness range was set to within a range of from 140 to 255, and a portion having high brightness on one particle of the toner was extracted.

Then, each particle of the extracted particle group was subjected to the same processing until the number of the toner particles to be selected reached 100. When the number of the toner particles in one field of view was less than 100, the same operation was repeated with respect to a toner projection image in another field of view.

Regarding the obtained 100 toner particles, the projection area circle-equivalent diameters were arranged in ascending order, and the projection area circle-equivalent diameter of the toner particle corresponding to the 50th toner particle was defined as a median diameter (D50) on a number basis of the toner in the present disclosure.

<Method of Measuring Amounts of Titanate Particles and Silica Fine Particles separated from Toner when Toner is Washed with Water>

(Preparation of Sample)

Toner before water washing: Various toners produced in Examples described later were directly used.

Toner after water washing: 6 mL of "Contaminon N", 31 g of a sucrose liquid (sucrose:pure water=2:1), and 1 g of toner are mixed in a vial with a capacity of 50 mL. The vial is set on a shaker "YS-8D" (manufactured by Yayoi Co., Ltd.) and shaken at 200 rpm for 5 minutes to liberate the toner and the external additives from each other. After that, the resultant is centrifuged at 3,700 rpm for 30 minutes through use of a centrifuge "H-19S" (manufactured by Kokusan Co., Ltd.) to separate the toner and the aqueous solution from each other. The toner is collected from the aqueous solution, and vacuum filtration is performed until a contained detergent is eliminated. Then, the resultant is dried at 50° C. under normal pressure for 12 hours or more. A pressure of 20 kPa is applied to the sample before and after water washing for 1 minute through use of a molding compressor, to thereby mold the sample to a pellet having a diameter of about 15 mm and a thickness of about 2 mm.

Each pellet was measured in a mode of investigating only Si and Ti with a high-output fluorescent X-ray analyzer "AxiosmAX" (manufactured by Malvern Panalytical Ltd.), and a difference in fluorescent X-ray intensity (unit: kcps) of elements in association with the external additives was defined as an amount of the external additives separated from the toner by water washing.

(ii) Measurement Conditions

Measurement conditions for mode of investigating only Si
Measurement angle: 104.1298° to 114.1298°
Step size: 0.05°
Measurement time: 50 sec
Measurement potential and current: 25 kV and 160 mA
Measurement conditions for mode of investigating only Ti
Measurement angle: 84.1398° to 88.1398°
Step size: 0.04°
Measurement time: 20 sec
Measurement potential and current: 40 kV and 100 mA

EXAMPLES

First Embodiment

Examples A-1 to A-22 and Comparative Examples A-1 to A-14

<Description of Durability Test of Charging Roller and Evaluation Method>

Next, an electrophotographic apparatus used for a durability test of a charging roller and image evaluation is briefly described. As an electrophotographic copying machine used in this test, a remodeled machine of a full-color copying machine "imageRUNNER ADVANCE C5500" manufactured by Canon Inc. was used. A process cartridge station for a cyan color was used.

The above-mentioned electrophotographic apparatus is a machine for A3 horizontal output. The output speed of recording media thereof is 264 mm/sec, and the image resolution thereof is 600 dpi. A photosensitive member is a photosensitive drum of a reversal development system in which an aluminum cylinder is coated with an organic photoconductor layer (OPC layer), and further coated with an overcoat layer (OCL layer).

The charging system of the photosensitive member is a direct current charging system (DC charging system).

Toner is obtained by externally adding silica particles and strontium titanate particles to pulverized toner particles containing polyester serving as a binder resin and a wax, and having a number average particle diameter of 5.0 μm.

Physical properties of a charging roller, strontium titanate, and silica particles used in each Example and each Comparative Example are shown in Table 1 and Table 2.

The contamination of the charging roller was evaluated by performing a continuous durability test of 100,000 sheets in which a copying machine to be evaluated for an image output an image with an image ratio of 30% under a normal-temperature and low-humidity (N/L: temperature of 23° C./relative humidity of 5%) environment.

As evaluation images, the following two kinds were used.

One kind of the evaluation images is an image that is directly developed to a dark portion potential VD formed on a surface of the photosensitive member 1 with the charging roller (hereinafter referred to as "analog halftone (HT)"). Specifically, the surface of a photosensitive drum is charged to about −700 V as the dark portion potential VD, and the potential of a developing sleeve is set to about −720 V. Thus, the image is developed to the dark portion potential VD. Under this condition, charging unevenness caused by contamination of the charging roller is directly reflected on the image, and hence the contamination can be evaluated under a severe condition.

In the other kind of the evaluation images, a method involving forming an image through ordinary image exposure was used (hereinafter referred to as "digital halftone (HT)"). Specifically, the surface of the photosensitive drum is charged to about −700 V as the dark portion potential VD, and after that, the surface is charged to about −600 V as a light portion potential VL through whole-surface image exposure. Then, the developing sleeve potential is set to about −600 V to develop the image to the light portion potential VL. The above-mentioned images were each adjusted so as to be a halftone image in which a reflection density measured with X-Rite fell within a range of from 0.3 to 0.6. Evaluation was performed in accordance with the following evaluation ranks. The evaluation results are shown in Table 1 and Table 2.

Rank A: Charging unevenness does not occur in an image even in analog HT.

Rank B: Unevenness occurs in a streak shape in analog HT, but does not occur in an image in digital HT.

Rank C: Unevenness occurs slightly in digital HT, but has no problem in terms of practical use.

Rank D: Unevenness and streaks can be confirmed clearly in digital HT.

TABLE 1

| | Charging roller | | Strontium titanate particles | | | | | | |
|---|---|---|---|---|---|---|---|---|---|
| | Roughness of outermost surface layer [μm] | Roughness of non-particle portion [μm] | D1T [nm] | Average circularity | Half width of maximum peak (a) | (Ix)/(Ia) | Total of contents of strontium oxide and titanium oxide [% by mass] | Content of strontium titanate particles with respect to 100 parts by mass of toner particles [parts by mass] | Ratio of amount of strontium titanate particles separated from toner with respect to amount of silica particles separated from toner when toner is washed with water |
| Example A-1 | 1.1 | 0.5 | 50 | 0.810 | 0.37 | 0.005 | 99.0 | 0.30 | 0.3 |
| Example A-2 | 19 | 0.5 | 50 | 0.810 | 0.37 | 0.005 | 99.0 | 0.30 | 0.3 |
| Example A-3 | 10 | 0.9 | 50 | 0.810 | 0.37 | 0.005 | 99.0 | 0.30 | 0.3 |
| Example A-4 | 10 | 0.5 | 15 | 0.810 | 0.37 | 0.005 | 99.0 | 0.30 | 0.3 |
| Example A-5 | 10 | 0.5 | 90 | 0.810 | 0.37 | 0.005 | 99.0 | 0.27 | 0.3 |
| Example A-6 | 10 | 0.5 | 50 | 0.750 | 0.37 | 0.005 | 99.0 | 0.30 | 0.3 |
| Example A-7 | 10 | 0.5 | 50 | 0.910 | 0.37 | 0.005 | 99.0 | 0.30 | 0.3 |
| Example A-8 | 10 | 0.5 | 50 | 0.810 | 0.25 | 0.005 | 99.0 | 0.30 | 0.3 |
| Example A-9 | 10 | 0.5 | 50 | 0.810 | 0.48 | 0.005 | 99.0 | 0.30 | 0.3 |
| Example A-10 | 10 | 0.5 | 50 | 0.810 | 0.37 | 0.0092 | 99.0 | 0.30 | 0.3 |
| Example A-11 | 10 | 0.5 | 50 | 0.810 | 0.37 | 0.005 | 98.3 | 0.30 | 0.3 |
| Example A-12 | 10 | 0.5 | 50 | 0.810 | 0.37 | 0.005 | 99.0 | 0.20 | 0.3 |
| Example A-13 | 10 | 0.5 | 50 | 0.810 | 0.37 | 0.005 | 99.0 | 0.42 | 0.3 |
| Example A-14 | 10 | 0.5 | 50 | 0.810 | 0.37 | 0.005 | 99.0 | 0.23 | 0.23 |
| Example A-15 | 10 | 0.5 | 50 | 0.810 | 0.37 | 0.005 | 99.0 | 0.27 | 0.3 |
| Example A-16 | 10 | 0.5 | 50 | 0.810 | 0.37 | 0.005 | 99.0 | 0.42 | 0.3 |
| Example A-17 | 10 | 0.5 | 50 | 0.810 | 0.37 | 0.005 | 99.0 | 0.30 | 0.3 |
| Example A-18 | 10 | 0.5 | 50 | 0.810 | 0.37 | 0.005 | 99.0 | 0.30 | 0.3 |
| Example A-19 | 10 | 0.5 | 50 | 0.810 | 0.37 | 0.005 | 99.0 | 0.30 | 0.3 |
| Example A-20 | 10 | 0.5 | 50 | 0.810 | 0.37 | 0.005 | 99.0 | 0.30 | 0.3 |
| Example A-21 | 10 | 0.5 | 50 | 0.810 | 0.37 | 0.005 | 99.0 | 0.30 | 0.3 |
| Example A-22 | 10 | 0.5 | 50 | 0.810 | 0.37 | 0.005 | 99.0 | 0.30 | 0.3 |

| | Silica particles | | | | | | | |
|---|---|---|---|---|---|---|---|---|
| | D1S [nm] | Total content of silica particles with respect to 100 parts by mass of toner particles [parts by mass] | D1S2 [nm] | Content of large silica particles with respect to 100 parts by mass of toner particles [parts by mass] | D1S1 [nm] | Content of small silica particles with respect to 100 parts by mass of toner particles [parts by mass] | Toner Median diameter (D50) [μm] | Evaluation Evaluation of image |
| Example A-1 | 100 | 1.0 | 110 | 0.989 | 15 | 0.011 | 5.0 | A |
| Example A-2 | 100 | 1.0 | 110 | 0.989 | 15 | 0.011 | 5.0 | A |
| Example A-3 | 100 | 1.0 | 110 | 0.989 | 15 | 0.011 | 5.0 | A |
| Example A-4 | 100 | 1.0 | 110 | 0.989 | 15 | 0.011 | 5.0 | A |
| Example A-5 | 100 | 1.0 | 110 | 0.989 | 15 | 0.011 | 5.0 | A |
| Example A-6 | 100 | 1.0 | 110 | 0.989 | 15 | 0.011 | 5.0 | A |
| Example A-7 | 100 | 1.0 | 110 | 0.989 | 15 | 0.011 | 5.0 | A |
| Example A-8 | 100 | 1.0 | 110 | 0.989 | 15 | 0.011 | 5.0 | A |
| Example A-9 | 100 | 1.0 | 110 | 0.989 | 15 | 0.011 | 5.0 | A |
| Example A-10 | 100 | 1.0 | 110 | 0.989 | 15 | 0.011 | 5.0 | A |
| Example A-11 | 100 | 1.0 | 110 | 0.989 | 15 | 0.011 | 5.0 | A |
| Example A-12 | 10 | 1.0 | 80 | 0.907 | 5 | 0.093 | 5.0 | A |
| Example A-13 | 290 | 1.0 | 350 | 0.982 | 20 | 0.018 | 5.0 | A |
| Example A-14 | 100 | 1.0 | 110 | 0.989 | 15 | 0.011 | 5.0 | A |
| Example A-15 | 100 | 0.9 | 110 | 0.889 | 15 | 0.011 | 5.0 | A |
| Example A-16 | 100 | 1.4 | 110 | 1.389 | 15 | 0.011 | 5.0 | A |
| Example A-17 | 100 | 1.0 | 110 | 0.990 | 7 | 0.010 | 5.0 | A |
| Example A-18 | 100 | 1.0 | 110 | 0.987 | 18 | 0.013 | 5.0 | A |
| Example A-19 | 100 | 1.0 | 85 | 0.994 | 15 | 0.006 | 5.0 | A |
| Example A-20 | 100 | 1.0 | 115 | 0.985 | 15 | 0.015 | 5.0 | A |
| Example A-21 | 100 | 1.0 | 110 | 0.989 | 15 | 0.011 | 4.5 | A |
| Example A-22 | 100 | 1.0 | 110 | 0.989 | 15 | 0.011 | 5.8 | A |

TABLE 2

| | Charging roller | | Strontium titanate particles | | | | | | |
|---|---|---|---|---|---|---|---|---|---|
| | Roughness of outermost surface layer [μm] | Roughness of non-particle portion [μm] | D1T [nm] | Average circularity | Half width of maximum peak (a) | (Ix)/(Ia) | Total of contents of strontium oxide and titanium oxide [% by mass] | Content of strontium titanate particles with respect to 100 parts by mass of toner particles [parts by mass] | Ratio of amount of strontium titanate particles separated from toner with respect to amount of silica particles separated from toner when toner is washed with water |
| Comparative Example A-1 | 0.6 | 0.5 | 50 | 0.810 | 0.37 | 0.005 | 99.0 | 0.30 | 0.3 |
| Comparative Example A-2 | 25 | 0.5 | 50 | 0.810 | 0.37 | 0.005 | 99.0 | 0.30 | 0.3 |
| Comparative Example A-3 | 10 | 5 | 50 | 0.810 | 0.37 | 0.005 | 99.0 | 0.30 | 0.3 |
| Comparative Example A-4 | 10 | 0.5 | 5 | 0.810 | 0.37 | 0.005 | 99.0 | 0.30 | 0.3 |
| Comparative Example A-5 | 10 | 0.5 | 100 | 0.810 | 0.37 | 0.005 | 99.0 | 0.25 | 0.3 |
| Comparative Example A-6 | 10 | 0.5 | 50 | 0.600 | 0.37 | 0.005 | 99.0 | 0.30 | 0.3 |
| Comparative Example A-7 | 10 | 0.5 | 50 | 0.970 | 0.37 | 0.005 | 99.0 | 0.30 | 0.3 |
| Comparative Example A-8 | 10 | 0.5 | 50 | 0.810 | 0.2 | 0.005 | 99.0 | 0.30 | 0.3 |
| Comparative Example A-9 | 10 | 0.5 | 50 | 0.810 | 0.7 | 0.005 | 99.0 | 0.30 | 0.3 |
| Comparative Example A-10 | 10 | 0.5 | 50 | 0.810 | 0.37 | 0.02 | 99.0 | 0.30 | 0.3 |
| Comparative Example A-11 | 10 | 0.5 | 50 | 0.810 | 0.37 | 0.005 | 85.0 | 0.30 | 0.3 |
| Comparative Example A-12 | 10 | 0.5 | 50 | 0.810 | 0.37 | 0.005 | 99.0 | 0.10 | 0.3 |
| Comparative Example A-13 | 10 | 0.5 | 50 | 0.810 | 0.37 | 0.005 | 99.0 | 0.52 | 0.3 |
| Comparative Example A-14 | 10 | 0.5 | 50 | 0.810 | 0.37 | 0.005 | 99.0 | 0.10 | 0.1 |

| | Silica particles | | | | | | | |
|---|---|---|---|---|---|---|---|---|
| | D1S [nm] | Total content of silica particles with respect to 100 parts by mass of toner particles | D1S2 [nm] | Content of large silica particles with respect to 100 parts by mass of toner particles [parts by mass] | D1S1 [nm] | Content of small silica particles with respect to 100 parts by mass of toner particles [parts by mass] | Toner Median diameter (D50) | Evaluation Evaluation of image |
| Comparative Example A-1 | 100 | 1.0 | 110 | 0.989 | 15 | 0.011 | 5.0 | D |
| Comparative Example A-2 | 100 | 1.0 | 110 | 0.989 | 15 | 0.011 | 5.0 | D |
| Comparative Example A-3 | 100 | 1.0 | 110 | 0.989 | 15 | 0.011 | 5.0 | D |
| Comparative Example A-4 | 100 | 1.0 | 110 | 0.989 | 15 | 0.011 | 5.0 | C |
| Comparative Example A-5 | 100 | 1.0 | 110 | 0.989 | 15 | 0.011 | 5.0 | C |
| Comparative Example A-6 | 100 | 1.0 | 110 | 0.989 | 15 | 0.011 | 5.0 | C |
| Comparative Example A-7 | 100 | 1.0 | 110 | 0.989 | 15 | 0.011 | 5.0 | C |
| Comparative Example A-8 | 100 | 1.0 | 110 | 0.989 | 15 | 0.011 | 5.0 | C |
| Comparative Example A-9 | 100 | 1.0 | 110 | 0.989 | 15 | 0.011 | 5.0 | C |
| Comparative Example A-10 | 100 | 1.0 | 110 | 0.989 | 15 | 0.011 | 5.0 | C |

TABLE 2-continued

| | | | | | | | | |
|---|---|---|---|---|---|---|---|---|
| Comparative Example A-11 | 100 | 1.0 | 110 | 0.989 | 15 | 0.011 | 5.0 | C |
| Comparative Example A-12 | 4 | 1.0 | 5 | 0.975 | 1 | 0.025 | 5.0 | D |
| Comparative Example A-13 | 500 | 1.0 | 600 | 0.980 | 100 | 0.020 | 5.0 | D |
| Comparative Example A-14 | 100 | 1.0 | 110 | 0.989 | 15 | 0.011 | 5.0 | C |

Example A-23

It is preferred that an actually measured value of the amount of the silica particles separated from the toner when the toner is washed with water be 1.9 or less. In this case, the effect of suppressing contamination caused by the external additives can be more satisfactorily maintained.

The condition under which verification was conducted in this Example is shown in Table 3.

Example A-24

When an actually measured value of the amount of the strontium titanate particles separated from the toner when the toner is washed with water is 0.5 or less, the effect of suppressing contamination caused by the external additives can be more satisfactorily maintained.

The condition under which verification was conducted in this Example is shown in Table 3.

TABLE 3

| | Charging roller | | Strontium titanate particles | | | | | | |
|---|---|---|---|---|---|---|---|---|---|
| | Roughness of outermost surface layer [μm] | Roughness of non-particle portion [μm] | D1T [nm] | Average circularity | Half width of maximum peak (a) | (Ix)/(Ia) | Total of contents of strontium oxide and titanium oxide [% by mass] | Ratio of amount of strontium titanate particles separated from toner with respect to amount of silica particles separated from toner when toner is washed with water | Amount of strontium titanate particles separated from toner when toner is washed with water |
| Example A-23 | 10 | 0.5 | 50 | 0.810 | 0.37 | 0.005 | 99.0 | 4.8 | 0.357 |
| Example A-24 | 10 | 0.5 | 50 | 0.810 | 0.37 | 0.005 | 99.0 | 1.4 | 0.455 |

| | Silica particles | | | | | | |
|---|---|---|---|---|---|---|---|
| | D1S [nm] | Total content of silica particles with respect to 100 parts by mass of toner particles [parts by mass] | D1S2 [nm] | D1S1 [nm] | Amount of silica particles separated from toner when toner is washed with water | Toner Median diameter (D50) [μm] | Evaluation Evaluation of image |
| Example A-23 | 100 | 1.0 | 110 | 15 | 1.7 | 5.0 | A |
| Example A-24 | 100 | 1.0 | 110 | 15 | 0.65 | 5.0 | A |

Second Embodiment

Examples B-1 to B-23 and Comparative Examples B-1 to B-15

<Description of Durability Test of Charging Roller and Evaluation Method>

Next, an electrophotographic apparatus used for a durability test of a charging roller and image evaluation is described. As an electrophotographic copying machine used in this test, a full-color copying machine "imageRUNNER ADVANCE C5500" manufactured by Canon Inc. was used. A process cartridge station for a cyan color was used.

The above-mentioned electrophotographic apparatus is a machine for A3 horizontal output. The output speed of recording media thereof is 264 mm/sec, and the image resolution thereof is 600 dpi. A photosensitive member is a photosensitive drum of a reversal development system in which an aluminum cylinder is coated with an organic photoconductor layer (OPC layer), and further coated with an overcoat layer (OCL layer).

The charging system of the photosensitive member is an "alternating current+direct current charging system" (AC+DC superimposed charging system) using a DC voltage having an AC voltage superimposed thereon.

Toner is obtained by externally adding silica particles and strontium titanate particles to pulverized toner particles containing polyester serving as a binder resin and a wax, and having a number average particle diameter of 5.0 μm.

Physical properties of a charging roller, strontium titanate, and silica particles used in each Example and each Comparative Example are shown in Table 4 and Table 5.

The contamination of the charging roller was evaluated by performing a continuous durability test of 100,000 sheets in which a copying machine to be evaluated for an image output an image with an image ratio of 30% under a normal-temperature and low-humidity (N/L: temperature of 23° C./relative humidity of 5%) environment.

As evaluation images, the following two kinds were used.

One kind of the evaluation images is an image that is directly developed to a dark portion potential VD formed on a surface of the photosensitive member 1 with the charging roller (hereinafter referred to as "analog halftone (HT)"). Specifically, the surface of a photosensitive drum is charged to about −500 V as the dark portion potential VD, and the potential of a developing sleeve is set to about −500 V. Thus, the image is developed to the dark portion potential VD. Under this condition, charging unevenness caused by contamination of the charging roller is directly reflected on the image, and hence the contamination can be evaluated under a severe condition.

In the other kind of the evaluation images, a method involving forming an image through ordinary image exposure was used (hereinafter referred to as "digital halftone (HT)"). Specifically, the surface of the photosensitive drum is charged to about −500 V as the dark portion potential VD, and after that, the surface is charged to about −430 V as a light portion potential VL through whole-surface image exposure. Then, the developing sleeve potential is set to about −370 V to develop the image to the light portion potential VL. The above-mentioned images were each adjusted so as to be a halftone image in which a reflection density measured with X-Rite fell within a range of from 0.3 to 0.6. Evaluation was performed in accordance with the following evaluation ranks.

Rank A: Charging unevenness does not occur in an image even in analog HT.

Rank B: Unevenness occurs in a streak shape in analog HT, but does not occur in an image in digital HT.

Rank C: Unevenness occurs slightly in digital HT, but has no problem in terms of practical use.

Rank D: Unevenness and streaks can be confirmed clearly in digital HT.

<Evaluation Results of Charging Roller>

Based on the above-mentioned configuration and formulation, results obtained by performing evaluation of contamination of a charging roller in a developer in which a production method, a classification condition, and the like are changed are shown in Table 6 and Table 7.

As shown in Table 6 and Table 7, according to the present disclosure, in a charging device using an AC+DC superimposed charging system of a copying machine, a printer, and the like, the contamination of a charging roller after endurance was suppressed, and an image forming apparatus without occurrence of an image failure was able to be provided.

TABLE 4

| | Charging roller | | Strontium titanate particles | | | | | | |
|---|---|---|---|---|---|---|---|---|---|
| | Roughness of outermost surface layer [μm] | Roughness of non-particle portion [μm] | D1T [nm] | Average circularity | Half width of maximum peak (a) | (Ix)/(Ia) | Total of contents of strontium oxide and titanium oxide [% by mass] | Content of strontium titanate particles with respect to 100 parts by mass of toner particles [parts by mass] | Ratio of amount of strontium titanate particles separated from toner with respect to amount of silica particles separated from toner when toner is washed with water |
| Example B-1 | 1.1 | 0.5 | 50 | 0.810 | 0.37 | 0.005 | 99.0 | 0.30 | 0.3 |
| Example B-2 | 19 | 0.5 | 50 | 0.810 | 0.37 | 0.005 | 99.0 | 0.30 | 0.3 |
| Example B-3 | 10 | 0.9 | 50 | 0.810 | 0.37 | 0.005 | 99.0 | 0.30 | 0.3 |
| Example B-4 | 10 | 0.5 | 11 | 0.810 | 0.37 | 0.005 | 99.0 | 0.30 | 0.3 |
| Example B-5 | 10 | 0.5 | 94 | 0.810 | 0.37 | 0.005 | 99.0 | 0.28 | 0.3 |
| Example B-6 | 10 | 0.5 | 50 | 0.710 | 0.37 | 0.005 | 99.0 | 0.30 | 0.3 |
| Example B-7 | 10 | 0.5 | 50 | 0.910 | 0.37 | 0.005 | 99.0 | 0.30 | 0.3 |
| Example B-8 | 10 | 0.5 | 50 | 0.810 | 0.24 | 0.005 | 99.0 | 0.30 | 0.3 |

TABLE 4-continued

| | | | | | | | | | |
|---|---|---|---|---|---|---|---|---|---|
| Example B-9 | 10 | 0.5 | 50 | 0.810 | 0.49 | 0.005 | 99.0 | 0.30 | 0.3 |
| Example B-10 | 10 | 0.5 | 50 | 0.810 | 0.37 | 0.009 | 99.0 | 0.30 | 0.3 |
| Example B-11 | 10 | 0.5 | 50 | 0.810 | 0.37 | 0.005 | 98.1 | 0.30 | 0.3 |
| Example B-12 | 10 | 0.5 | 50 | 0.810 | 0.37 | 0.005 | 99.0 | 0.20 | 0.3 |
| Example B-13 | 10 | 0.5 | 50 | 0.810 | 0.37 | 0.005 | 99.0 | 0.42 | 0.3 |
| Example B-14 | 10 | 0.5 | 50 | 0.810 | 0.37 | 0.005 | 99.0 | 0.05 | 0.02 |
| Example B-15 | 10 | 0.5 | 50 | 0.810 | 0.37 | 0.005 | 99.0 | 0.58 | 0.58 |
| Example B-16 | 10 | 0.5 | 50 | 0.810 | 0.37 | 0.005 | 99.0 | 0.27 | 0.3 |
| Example B-17 | 10 | 0.5 | 50 | 0.810 | 0.37 | 0.005 | 99.0 | 0.42 | 0.3 |
| Example B-18 | 10 | 0.5 | 50 | 0.810 | 0.37 | 0.005 | 99.0 | 0.30 | 0.3 |
| Example B-19 | 10 | 0.5 | 50 | 0.810 | 0.37 | 0.005 | 99.0 | 0.30 | 0.3 |
| Example B-20 | 10 | 0.5 | 50 | 0.810 | 0.37 | 0.005 | 99.0 | 0.30 | 0.3 |
| Example B-21 | 10 | 0.5 | 50 | 0.810 | 0.37 | 0.005 | 99.0 | 0.30 | 0.3 |
| Example B-22 | 10 | 0.5 | 50 | 0.810 | 0.37 | 0.005 | 99.0 | 0.30 | 0.3 |
| Example B-23 | 10 | 0.5 | 50 | 0.810 | 0.37 | 0.005 | 99.0 | 0.30 | 0.3 |

| | Silica particles | | | | | | | |
|---|---|---|---|---|---|---|---|---|
| | D1S [nm] | Total content of silica particles with respect to 100 parts by mass of toner particles [parts by mass] | D1S2 [nm] | Content of large silica particles with respect to 100 parts by mass of toner particles [parts by mass] | D1S1 [nm] | Content of small silica particles with respect to 100 parts by mass of toner particles [parts by mass] | Toner Median diameter (D50) [μm] | Evaluation Evaluation of image |
| Example B-1 | 100 | 1.0 | 110 | 0.989 | 15 | 0.011 | 5.0 | A |
| Example B-2 | 100 | 1.0 | 110 | 0.989 | 15 | 0.011 | 5.0 | A |
| Example B-3 | 100 | 1.0 | 110 | 0.989 | 15 | 0.011 | 5.0 | A |
| Example B-4 | 100 | 1.0 | 110 | 0.989 | 15 | 0.011 | 5.0 | A |
| Example B-5 | 100 | 1.0 | 110 | 0.989 | 15 | 0.011 | 5.0 | A |
| Example B-6 | 100 | 1.0 | 110 | 0.989 | 15 | 0.011 | 5.0 | A |
| Example B-7 | 100 | 1.0 | 110 | 0.989 | 15 | 0.011 | 5.0 | A |
| Example B-8 | 100 | 1.0 | 110 | 0.989 | 15 | 0.011 | 5.0 | A |
| Example B-9 | 100 | 1.0 | 110 | 0.989 | 15 | 0.011 | 5.0 | A |
| Example B-10 | 100 | 1.0 | 110 | 0.989 | 15 | 0.011 | 5.0 | A |
| Example B-11 | 100 | 1.0 | 110 | 0.989 | 15 | 0.011 | 5.0 | A |
| Example B-12 | 10 | 1.0 | 80 | 0.907 | 5 | 0.093 | 5.0 | A |
| Example B-13 | 290 | 1.0 | 350 | 0.982 | 20 | 0.018 | 5.0 | A |
| Example B-14 | 100 | 1.0 | 110 | 0.989 | 15 | 0.011 | 5.0 | A |
| Example B-15 | 100 | 1.0 | 110 | 0.989 | 15 | 0.011 | 5.0 | A |
| Example B-16 | 100 | 0.9 | 110 | 0.889 | 15 | 0.011 | 5.0 | A |
| Example B-17 | 100 | 1.4 | 110 | 1.389 | 15 | 0.011 | 5.0 | A |
| Example B-18 | 100 | 1.0 | 110 | 0.991 | 6 | 0.009 | 5.0 | A |
| Example B-19 | 100 | 1.0 | 110 | 0.985 | 18 | 0.015 | 5.0 | A |
| Example B-20 | 100 | 1.0 | 105 | 0.994 | 15 | 0.006 | 5.0 | A |
| Example B-21 | 100 | 1.0 | 115 | 0.985 | 15 | 0.015 | 5.0 | A |
| Example B-22 | 100 | 1.0 | 110 | 0.989 | 15 | 0.011 | 3.2 | A |
| Example B-23 | 100 | 1.0 | 110 | 0.989 | 15 | 0.011 | 5.9 | A |

TABLE 5

| | Charging roller | | Strontium titanate particles | | | | | | |
|---|---|---|---|---|---|---|---|---|---|
| | Roughness of outermost surface layer [μm] | Roughness of non-particle portion [μm] | D1T [nm] | Average circularity | Half width of maximum peak (a) | (Ix)/(Ia) | Total of contents of strontium oxide and titanium oxide [% by mass] | Content of strontium titanate particles with respect to 100 parts by mass of toner particles [parts by mass] | Ratio of amount of strontium titanate particles separated from toner with respect to amount of silica particles separated from toner when toner is washed with water |
| Comparative Example B-1 | 0.6 | 0.5 | 50 | 0.810 | 0.37 | 0.005 | 99.0 | 0.30 | 0.3 |
| Comparative Example B-2 | 25 | 0.5 | 50 | 0.810 | 0.37 | 0.005 | 99.0 | 0.30 | 0.3 |

TABLE 5-continued

| | | | | | | | | | |
|---|---|---|---|---|---|---|---|---|---|
| Comparative Example B-3 | 10 | 5 | 50 | 0.810 | 0.37 | 0.005 | 99.0 | 0.30 | 0.3 |
| Comparative Example B-4 | 10 | 0.5 | 8 | 0.810 | 0.37 | 0.005 | 99.0 | 0.30 | 0.3 |
| Comparative Example B-5 | 10 | 0.5 | 100 | 0.810 | 0.37 | 0.005 | 99.0 | 0.25 | 0.3 |
| Comparative Example B-6 | 10 | 0.5 | 50 | 0.650 | 0.37 | 0.005 | 99.0 | 0.30 | 0.3 |
| Comparative Example B-7 | 10 | 0.5 | 50 | 0.950 | 0.37 | 0.005 | 99.0 | 0.30 | 0.3 |
| Comparative Example B-8 | 10 | 0.5 | 50 | 0.810 | 0.2 | 0.005 | 99.0 | 0.30 | 0.3 |
| Comparative Example B-9 | 10 | 0.5 | 50 | 0.810 | 0.55 | 0.005 | 99.0 | 0.30 | 0.3 |
| Comparative Example B-10 | 10 | 0.5 | 50 | 0.810 | 0.37 | 0.012 | 99.0 | 0.30 | 0.3 |
| Comparative Example B-11 | 10 | 0.5 | 50 | 0.810 | 0.37 | 0.005 | 95.0 | 0.30 | 0.3 |
| Comparative Example B-12 | 10 | 0.5 | 50 | 0.810 | 0.37 | 0.005 | 99.0 | 0.10 | 0.3 |
| Comparative Example B-13 | 10 | 0.5 | 50 | 0.810 | 0.37 | 0.005 | 99.0 | 0.52 | 0.3 |
| Comparative Example B-14 | 10 | 0.5 | 50 | 0.810 | 0.37 | 0.005 | 99.0 | 0.005 | 0.005 |
| Comparative Example B-15 | 10 | 0.5 | 50 | 0.810 | 0.37 | 0.005 | 99.0 | 1.0 | 1 |

| | Silica particles | | | | | | | |
|---|---|---|---|---|---|---|---|---|
| | D1S [nm] | Total content of silica particles with respect to 100 parts by mass of toner particles | D1S2 [nm] | Content of large silica particles with respect to 100 parts by mass of toner particles [parts by mass] | D1S1 [nm] | Content of small silica particles with respect to 100 parts by mass of toner particles [parts by mass] | Toner Median diameter (D50) [μm] | Evaluation Evaluation of image |
| Comparative Example B-1 | 100 | 1.0 | 110 | 0.989 | 15 | 0.011 | 5.0 | D |
| Comparative Example B-2 | 100 | 1.0 | 110 | 0.989 | 15 | 0.011 | 5.0 | D |
| Comparative Example B-3 | 100 | 1.0 | 110 | 0.989 | 15 | 0.011 | 5.0 | D |
| Comparative Example B-4 | 100 | 1.0 | 110 | 0.989 | 15 | 0.011 | 5.0 | C |
| Comparative Example B-5 | 100 | 1.0 | 110 | 0.989 | 15 | 0.011 | 5.0 | C |
| Comparative Example B-6 | 100 | 1.0 | 110 | 0.989 | 15 | 0.011 | 5.0 | C |
| Comparative Example B-7 | 100 | 1.0 | 110 | 0.989 | 15 | 0.011 | 5.0 | C |
| Comparative Example B-8 | 100 | 1.0 | 110 | 0.989 | 15 | 0.011 | 5.0 | C |
| Comparative Example B-9 | 100 | 1.0 | 110 | 0.989 | 15 | 0.011 | 5.0 | C |
| Comparative Example B-10 | 100 | 1.0 | 110 | 0.989 | 15 | 0.011 | 5.0 | C |
| Comparative Example B-11 | 100 | 1.0 | 110 | 0.989 | 15 | 0.011 | 5.0 | D |
| Comparative Example B-12 | 4 | 1.0 | 4 | 1.0 | — | — | 5.0 | D |
| Comparative Example B-13 | 500 | 1.0 | 600 | 0.980 | 100 | 0.020 | 5.0 | C |
| Comparative Example B-14 | 100 | 1.0 | 110 | 0.989 | 15 | 0.011 | 5.0 | C |
| Comparative Example B-15 | 100 | 1.0 | 110 | 0.989 | 15 | 0.011 | 5.0 | C |

Example B-24

It is preferred that an actually measured value of the amount of the silica particles separated from the toner when the toner is washed with water be 1.9 or less. In this case, the effect of suppressing contamination caused by the external additives can be more satisfactorily maintained.

In this case, the slipping amount of the toner from the cleaning blade to the charging roller can be reduced to a relatively small amount, and a toner blocking layer can be formed in a preferred state with the external additives in a cleaning blade nip portion.

The condition under which verification was conducted in this Example is shown in Table 6.

TABLE 6

| | Charging roller | | Strontium titanate particles | | | | | | |
|---|---|---|---|---|---|---|---|---|---|
| | Roughness of outermost surface layer [μm] | Roughness of non-particle portion [μm] | D1T [nm] | Average circularity | Half width of maximum peak (a) | (Ix)/(Ia) | Total of contents of strontium oxide and titanium oxide [% by mass] | Ratio of amount of strontium titanate particles separated from toner with respect to amount of silica particles separated from toner when toner is washed with water | Amount of strontium titanate particles separated from toner when toner is washed with water |
| Example B-24 | 10 | 0.5 | 50 | 0.810 | 0.37 | 0.005 | 99.0 | 0.3 | 0.51 |
| Example B-25 | 10 | 0.5 | 50 | 0.810 | 0.37 | 0.005 | 99.0 | 0.6 | 0.72 |

| | Silica particles | | | | | | |
|---|---|---|---|---|---|---|---|
| | D1S [nm] | Total content of silica particles with respect to 100 parts by mass of toner particles [parts by mass] | D1S2 [nm] | D1S1 [nm] | Amount of silica particles separated from toner when toner is washed with water | Toner Median diameter (D50) [μm] | Evaluation Evaluation of image |
| Example B-24 | 100 | 1.0 | 110 | 15 | 1.7 | 5.0 | A |
| Example B-25 | 100 | 1.0 | 110 | 15 | 1.2 | 5.0 | A |

In this case, the slipping amount of the toner from the cleaning blade to the charging roller can be reduced to a relatively small amount, and a toner blocking layer can be formed in a preferred state with the external additives in a cleaning blade nip portion.

The condition under which verification was conducted in this Example is shown in Table 6.

Example B-25

When an actually measured value of the amount of the strontium titanate particles separated from the toner when the toner is washed with water is 0.9 or less, the contamination caused by the external additives with respect to the charging roller applied in this Example is satisfactorily suppressed.

Third Embodiment

<Production Example of Binder Resin>

(Production Example of Polyester Resin)

Polyoxypropylene(2.2)-2,2-bis(4-hydroxyphenyl)propane: 80.0 mol % with respect to total number of moles of polyhydric alcohol Polyoxyethylene(2.2)-2,2-bis(4-hydroxyphenyl)propane: 20.0 mol % with respect to total number of moles of polyhydric alcohol Terephthalic acid: 80.0 mol % with respect to total number of moles of polyvalent carboxylic acid Trimellitic anhydride: 20.0 mol % with respect to total number of moles of polyvalent carboxylic acid The above-mentioned materials were loaded into a reaction vessel with a cooling tube, a stirrer, a nitrogen-introducing tube, and a thermocouple. Next, 1.5 parts of tin 2-ethylhexanoate (esterification catalyst) was added as a catalyst to 100 parts of the monomers in total. Then, the reaction vessel was purged with a nitrogen gas. After that, the temperature in the reaction vessel was gradually increased while the mixture was stirred. The mixture was subjected to a reaction for 2.5 hours while being stirred at a temperature of 200° C.

Further, the pressure in the reaction vessel was decreased to 8.3 kPa, and the reaction vessel was maintained in this state for 1 hour. After that, the temperature in the reaction vessel was cooled to 180° C. to allow the reaction to continue. After it was confirmed that the softening point measured in accordance with ASTM D36-86 reached 110° C., the temperature was decreased to stop the reaction.

<Production Example of Toner>

| | |
|---|---|
| Polyester resin | 100.0 parts |
| Aluminum 3,5-di-t-butylsalicylate compound | 0.1 part |
| Fischer-Tropsch wax (maximum endothermic peak temperature: 90° C.) | 5.0 parts |
| C.I. Pigment Blue 15:3 | 5.0 parts |

Raw materials described in the above-mentioned formulation were mixed under a predetermined condition through use of a Henschel mixer (FM75J, manufactured by Nippon Coke & Engineering Co., Ltd.). After that, the mixture was kneaded with a twin-screw kneader (PCM-30, manufactured by Ikegai Corp). The obtained kneaded product was cooled and coarsely pulverized to 1 mm or less with a hammer mill to obtain a coarsely pulverized product. The obtained coarsely pulverized product was finely pulverized with a mechanical pulverizer (T-250, manufactured by Freund-Turbo Corporation). The resultant was classified through use of Elbow-Jet of an inertial classification system (manufactured by Nittetsu Mining Co., Ltd.) to obtain toner particles.

Further, the obtained toner particles were subjected to the step of causing fine particles such as silica particles and strontium titanate to adhere to the surfaces of the toner particles, and then the toner particles were subjected to surface treatment with hot air. Thus, toner particles having the fine particles such as silica particles and strontium titanate adhering to the surfaces thereof were obtained. The toner particles having a circularity of 0.960 or more were obtained by adjusting the temperature of the hot air.

The obtained toner particles had a median diameter (D50) on a number basis of 5 μm. The median diameter (D50) on a number basis is adjusted by changing the conditions of pulverization and classification.

First and second silica particles and strontium titanate particles were further externally added to the toner particles subjected to the treatment with hot air as described above.

In addition, toners of kinds described later were obtained through use of appropriate production conditions by changing external additive formulations.

Physical properties of the strontium titanate particles and the silica particles used in each Example and each Comparative Example are shown in Table 7 and Table 8.

<Production Example of Magnetic Core Particles 1>

| Step 1 (Weighing and Mixing Step): | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 part |

Ferrite raw materials were weighed so that the above-mentioned materials had the above-mentioned composition ratio. After that, the materials were pulverized and mixed with a dry vibrating mill using stainless-steel beads each having a diameter of ⅛ inch for 5 hours.

Step 2 (Pre-calcining Step):

The resultant pulverized product was turned into a square pellet about 1 mm on a side with a roller compacter. Coarse powder was removed from the pellet with a vibrating sieve having an aperture of 3 mm. Then, fine powder was removed therefrom with a vibrating sieve having an aperture of 0.5 mm. After that, the remainder was calcined under a nitrogen atmosphere (oxygen concentration: 0.01 vol %) with a burner-type calcining furnace at a temperature of 1,000° C. for 4 hours to produce a pre-calcined ferrite. The composition of the resultant pre-calcined ferrite is as described below:

$$(MnO)_a(MgO)_b(SrO)_c(Fe_2O_3)_d$$

where, a=0.257, b=0.117, c=0.007, and d=0.393.

Step 3 (Pulverizing Step):

The pre-calcined ferrite was pulverized with a crusher into pieces each having a size of about 0.3 mm. After that, 30 parts of water with respect to 100 parts of the pre-calcined ferrite was added to the pieces, and then the mixture was pulverized with a wet ball mill using zirconia beads each having a diameter of ⅛ inch for 1 hour. The resultant slurry was pulverized with a wet ball mill using alumina beads each having a diameter of 1/16 inch for 4 hours. Thus, a ferrite slurry (finely pulverized product of the pre-calcined ferrite) was obtained.

Step 4 (Granulating Step):

One point zero part of ammonium polycarboxylate serving as a dispersant and 2.0 parts of polyvinyl alcohol serving as a binder with respect to 100 parts of the pre-calcined ferrite were added to the ferrite slurry, and then the mixture was granulated into spherical particles with a spray drier (manufacturer: Ohkawara Kakohki Co., Ltd.). The particle sizes of the resultant particles were adjusted, and then the dispersant and the binder serving as organic components were removed by heating the particles with a rotary kiln at 650° C. for 2 hours.

Step 5 (Calcining Step):

In order for a calcining atmosphere to be controlled, the temperature of the remainder was increased from room temperature to a temperature of 1,300° C. in an electric furnace under a nitrogen atmosphere (oxygen concentration: 1.00 vol %) in 2 hours, and then the remainder was calcined at a temperature of 1,150° C. for 4 hours. After that, the temperature of the calcined product was decreased to a temperature of 60° C. over 4 hours and the nitrogen atmosphere was returned to the air. When its temperature became 40° C. or less, the calcined product was taken out.

Step 6 (Sorting Step):

After an agglomerated particle had been shredded, a low-magnetic force product was discarded by magnetic separation, and coarse particles were removed by sieving with a sieve having an aperture of 250 μm. Thus, magnetic core particles 1 having a 50% particle diameter (D50) on a volume distribution basis of 37.0 μm were obtained.

<Preparation of Coating Resin 1>

| | |
|---|---|
| 1) Cyclohexyl methacrylate monomer | 26.8% by mass |
| 2) Methyl methacrylate monomer | 0.2% by mass |

-continued

| | |
|---|---|
| 3) Methyl methacrylate macromonomer (macromonomer having a methacryloyl group at one terminal and having a weight average molecular weight of 5,000) | 8.4% by mass |
| 4) Toluene | 31.3% by mass |
| 5) Methyl ethyl ketone | 31.3% by mass |
| 6) Azobisisobutyronitrile | 2.0% by mass |

Of the above-mentioned materials, 1), 2), 3), 4), and 5) were added to a four-necked separable flask with a reflux condenser, a temperature gauge, a nitrogen-introducing tube, and a stirrer. Then, a nitrogen gas was introduced into the flask to sufficiently establish a nitrogen atmosphere. After that, the temperature of the mixture was increased to 80° C. After that, azobisisobutyronitrile was added to the mixture, and the whole was polymerized by being refluxed for 5 hours. Hexane was injected into the resultant reaction product to precipitate and deposit a copolymer, and then the precipitate was separated by filtration. After that, the precipitate was vacuum-dried to provide a coating resin 1.

Thirty parts of the resultant coating resin 1 was dissolved in 40 parts of toluene and 30 parts of methyl ethyl ketone. Thus, a polymer solution 1 (solid content: 30% by mass) was obtained.

<Preparation of Coating Resin Solution 1>

| | |
|---|---|
| Polymer solution 1 (resin solid content concentration: 30%) | 33.3% by mass |
| Toluene | 66.4% by mass |
| Carbon black (REGAL 330; manufactured by Cabot) | 0.3% by mass |

(number average particle diameter of primary particles: 25 nm, nitrogen adsorption specific surface area: 94 $m^2/g$, DBP oil absorption: 75 mL/100 g)

The above-mentioned materials were dispersed with a paint shaker using zirconia beads each having a diameter of 0.5 mm for 1 hour. The resultant dispersion liquid was filtered through a 5.0-micrometer membrane filter. Thus, a coating resin solution 1 was obtained.

<Production Example of Magnetic Carrier 1>

(Resin Coating Step):

The coating resin solution 1 was charged into a vacuum deaeration-type kneader maintained at normal temperature so that its amount in terms of a resin component was 2.5 parts with respect to 100 parts of the magnetic core particles 1. After having been charged, the solution was stirred at a rotational speed of 30 rpm for 15 minutes. After a certain amount (80% by mass or more) or more of the solvent had been volatilized, the temperature in the kneader was increased to 80° C. while the remaining contents were mixed under reduced pressure. Toluene was removed by evaporation over 2 hours and then the residue was cooled.

A low-magnetic force product was separated from the resultant magnetic carrier by magnetic separation and then the remainder was passed through a sieve having an aperture of 70 After that, the resultant was classified with an air classifier. Thus, a magnetic carrier 1 having a 50% particle diameter (D50) on a volume distribution basis of 38.2 μm was obtained.

Toner was added to the magnetic carrier 1 so that a toner concentration became 8.0% by mass and the resultant was mixed with a V-type mixer (MODEL V-10: Tokuju Corporation) under the conditions of 0.5 $s^{-1}$ and a time of revolution of 5 minutes. Thus, a two-component developer was obtained.

Examples C-1 to C-22 and Comparative Examples C-1 to C-12

The following evaluation was performed through use of the obtained two-component developer. Evaluation results are shown in Table 7 and Table 8.

[Description of Durability Test using Corona Charging System and Evaluation Method]

Next, the durability test using a corona charging system and the experimental condition of image evaluation are briefly described. In Example 1, an outer diameter of the photosensitive drum was set to 84 mm, and a length thereof was set to 380 mm, and the output speed of recording media was set to 450 mm/s.

In Example 1, the cleaning member 50 was reciprocated for cleaning in 30 seconds, and the cleaning operation of the discharge wire 205 was set to start (the cleaning member 50 was configured to be reciprocated once) for every 1,300 sheets. When a certain amount or more of an adhering substance adheres to the discharge wire 205, density unevenness, such as streaks, occurs on a halftone. Hereinafter, the density unevenness, such as streaks, on the halftone, which is caused by an adhering substance (contaminant) adhering to the discharge wire 205, is referred to as "wire contamination".

Evaluation of Wire Contamination

A copying machine to be evaluated for an image output 1,000 sheets of an image with an image ratio of 10% under an environment of a temperature of 23° C. and a relative humidity of 5%, and after that, the copying machine output five sheets of each of the following two kinds of sample images for wire contamination evaluation. Those operations were performed for 200 sets, and thus density unevenness on a halftone image was evaluated.

First sample image: analog halftone image in which the reflection density measured with X-Rite falls within a range of from 0.3 to 0.7

Second sample image: digital halftone image in which the reflection density measured with X-Rite falls within a range of from 0.3 to 0.7

Wire contamination was evaluated through use of the above-mentioned two kinds of the analog halftone image and the digital halftone image as evaluation images.

One kind of the evaluation images is an image that is directly developed to a dark portion potential VD formed on a surface of the photosensitive drum 1 with the charging member (hereinafter referred to as "analog halftone (HT)"). Specifically, the surface of the photosensitive drum is charged to about −700 V as the dark portion potential VD, and the potential of a developing sleeve is set to about −720 V. Thus, the image is developed to the dark portion potential VD. Under this condition, charging unevenness caused by contamination of the discharge wire is directly reflected on the image, and hence the contamination can be evaluated under a severe condition.

In the other kind of the evaluation images, a method involving forming an image through ordinary image exposure was used (hereinafter referred to as "digital halftone (HT)"). Specifically, the surface of the photosensitive drum is charged to about −700 V as the dark portion potential VD, and after that, the surface is charged to about −600 V as a light portion potential VL through whole-surface image exposure. Then, the developing sleeve potential is set to about −600 V to develop the image to the light portion potential VL.

The above-mentioned images were each adjusted so as to be a halftone image in which the reflection density measured with X-Rite fell within a range of from 0.3 to 0.7.

Evaluation was performed in accordance with the following evaluation ranks.

Rank A: Charging unevenness does not occur in an image even in analog HT.

Rank B: Unevenness occurs in a streak shape in analog HT, but does not occur in an image in digital HT.

Rank C: Unevenness occurs slightly in digital HT, but has no problem in terms of practical use.

Rank D: Unevenness and streaks can be confirmed clearly in digital HT.

TABLE 7

| | Strontium titanate particles | | | | | | | |
|---|---|---|---|---|---|---|---|---|
| | D1T [nm] | Average circularity | Half width of maximum peak (a) | (Ix)/(Ia) | Total of contents of strontium oxide and titanium oxide [% by mass] | Ratio of amount of strontium titanate particles separated from toner with respect to amount of silica particles separated from toner when toner is washed with water | Content of strontium titanate particles with respect to 100 parts by mass of toner particles [parts by mass] | Amount of strontium titanate particles separated from toner when toner is washed with water |
| Example C-1 | 11 | 0.81 | 0.37 | 0.005 | 99 | 0.5 | 0.60 | 0.6 |
| Example C-2 | 94 | 0.81 | 0.37 | 0.005 | 99 | 0.5 | 0.60 | 0.6 |
| Example C-3 | 50 | 0.71 | 0.37 | 0.005 | 99 | 0.5 | 0.60 | 0.6 |
| Example C-4 | 50 | 0.91 | 0.37 | 0.005 | 99 | 0.5 | 0.60 | 0.6 |
| Example C-5 | 50 | 0.81 | 0.24 | 0.005 | 99 | 0.5 | 0.60 | 0.6 |
| Example C-6 | 50 | 0.81 | 0.49 | 0.005 | 99 | 0.5 | 0.60 | 0.6 |
| Example C-7 | 50 | 0.81 | 0.37 | 0.009 | 99 | 0.5 | 0.60 | 0.6 |
| Example C-8 | 50 | 0.81 | 0.37 | 0.005 | 98.1 | 0.5 | 0.60 | 0.6 |
| Example C-9 | 50 | 0.81 | 0.37 | 0.005 | 99 | 0.5 | 0.40 | 0.6 |
| Example C-10 | 50 | 0.81 | 0.37 | 0.005 | 99 | 0.5 | 0.90 | 0.6 |
| Example C-11 | 50 | 0.81 | 0.37 | 0.005 | 99 | 0.02 | 0.03 | 0.024 |
| Example C-12 | 50 | 0.81 | 0.37 | 0.005 | 99 | 0.89 | 1.10 | 1.07 |
| Example C-13 | 50 | 0.81 | 0.37 | 0.005 | 99 | 0.5 | 0.12 | 0.6 |
| Example C-14 | 50 | 0.81 | 0.37 | 0.005 | 99 | 0.5 | 0.84 | 0.6 |
| Example C-15 | 50 | 0.81 | 0.37 | 0.005 | 99 | 0.5 | 0.60 | 0.6 |
| Example C-16 | 50 | 0.81 | 0.37 | 0.005 | 99 | 0.5 | 0.60 | 0.6 |
| Example C-17 | 50 | 0.81 | 0.37 | 0.005 | 99 | 0.5 | 0.60 | 0.6 |
| Example C-18 | 50 | 0.81 | 0.37 | 0.005 | 99 | 0.5 | 0.60 | 0.6 |
| Example C-19 | 50 | 0.81 | 0.37 | 0.005 | 99 | 0.5 | 0.60 | 0.6 |
| Example C-20 | 50 | 0.81 | 0.37 | 0.005 | 99 | 0.5 | 0.60 | 0.6 |
| Example C-21 | 50 | 0.81 | 0.37 | 0.005 | 99 | 0.88 | 1.07 | 1.05 |
| Example C-22 | 50 | 0.81 | 0.37 | 0.005 | 99 | 0.5 | 1.30 | 1.2 |

| | Silica particles | | | | | | | | |
|---|---|---|---|---|---|---|---|---|---|
| | D1S [nm] | Total content of silica particles with respect to 100 parts by mass of toner particles [parts by mass] | D1S2 [nm] | Content of large silica particles with respect to 100 parts by mass of toner particles [parts by mass] | D1S1 [nm] | Content of small silica particles with respect to 100 parts by mass of toner particles [parts by mass] | Amount of silica particles separated from toner when toner is washed with water | Toner Median diameter (D50) | Evaluation Evaluation of image |
| Example C-1 | 100 | 1.0 | 110 | 0.989 | 15 | 0.011 | 1.2 | 5.0 | A |
| Example C-2 | 100 | 1.0 | 110 | 0.989 | 15 | 0.011 | 1.2 | 5.0 | A |
| Example C-3 | 100 | 1.0 | 110 | 0.989 | 15 | 0.011 | 1.2 | 5.0 | A |
| Example C-4 | 100 | 1.0 | 110 | 0.989 | 15 | 0.011 | 1.2 | 5.0 | A |
| Example C-5 | 100 | 1.0 | 110 | 0.989 | 15 | 0.011 | 1.2 | 5.0 | A |
| Example C-6 | 100 | 1.0 | 110 | 0.989 | 15 | 0.011 | 1.2 | 5.0 | A |
| Example C-7 | 100 | 1.0 | 110 | 0.989 | 15 | 0.011 | 1.2 | 5.0 | A |
| Example C-8 | 100 | 1.0 | 110 | 0.989 | 15 | 0.011 | 1.2 | 5.0 | A |
| Example C-9 | 10 | 1.0 | 80 | 0.907 | 5 | 0.093 | 1.2 | 5.0 | A |
| Example C-10 | 290 | 1.0 | 350 | 0.982 | 20 | 0.018 | 1.8 | 5.0 | A |
| Example C-11 | 100 | 1.0 | 110 | 0.989 | 15 | 0.011 | 1.2 | 5.0 | A |
| Example C-12 | 100 | 1.0 | 110 | 0.989 | 15 | 0.011 | 1.2 | 5.0 | A |

TABLE 7-continued

| | | | | | | | | | |
|---|---|---|---|---|---|---|---|---|---|
| Example C-13 | 100 | 0.2 | 110 | 0.198 | 15 | 0.002 | 1.2 | 5.0 | A |
| Example C-14 | 100 | 1.4 | 110 | 1.385 | 15 | 0.015 | 1.2 | 5.0 | A |
| Example C-15 | 100 | 1.0 | 110 | 0.991 | 6 | 0.009 | 1.2 | 5.0 | A |
| Example C-16 | 100 | 1.0 | 110 | 0.987 | 18 | 0.013 | 1.2 | 5.0 | A |
| Example C-17 | 100 | 1.0 | 105 | 0.994 | 15 | 0.006 | 1.2 | 5.0 | A |
| Example C-18 | 100 | 1.0 | 115 | 0.985 | 15 | 0.015 | 1.2 | 5.0 | A |
| Example C-19 | 100 | 1.0 | 110 | 0.989 | 15 | 0.011 | 1.2 | 3.2 | A |
| Example C-20 | 100 | 1.0 | 110 | 0.989 | 15 | 0.011 | 1.2 | 5.9 | A |
| Example C-21 | 100 | 1.0 | 110 | 0.989 | 15 | 0.011 | 1.2 | 4.5 | A |
| Example C-22 | 100 | 1.0 | 110 | 0.989 | 15 | 0.011 | 2.4 | 5.8 | A |

TABLE 8

| | Strontium titanate particles | | | | | | | |
|---|---|---|---|---|---|---|---|---|
| | D1T [nm] | Average circularity | Half width of maximum peak (a) | (Ix)/(Ia) | Total of contents of strontium oxide and titanium oxide [% by mass] | Ratio of amount of strontium titanate particles separated from toner with respect to amount of silica particles separated from toner when toner is washed with water | Content of strontium titanate particles with respect to 100 parts by mass of toner particles [parts by mass] | Amount of strontium titanate particles separated from toner when toner is washed with water |
| Comparative Example C-1 | 8 | 0.81 | 0.37 | 0.005 | 99 | 0.5 | 0.60 | 0.6 |
| Comparative Example C-2 | 100 | 0.81 | 0.37 | 0.005 | 99 | 0.5 | 0.60 | 0.6 |
| Comparative Example C-3 | 50 | 0.65 | 0.37 | 0.005 | 99 | 0.5 | 0.60 | 0.6 |
| Comparative Example C-4 | 50 | 0.95 | 0.37 | 0.005 | 99 | 0.5 | 0.60 | 0.6 |
| Comparative Example C-5 | 50 | 0.81 | 0.22 | 0.005 | 99 | 0.5 | 0.60 | 0.6 |
| Comparative Example C-6 | 50 | 0.81 | 0.55 | 0.005 | 99 | 0.5 | 0.60 | 0.6 |
| Comparative Example C-7 | 50 | 0.81 | 0.37 | 0.012 | 99 | 0.5 | 0.60 | 0.6 |
| Comparative Example C-8 | 50 | 0.81 | 0.37 | 0.005 | 95 | 0.5 | 0.60 | 0.6 |
| Comparative Example C-9 | 50 | 0.81 | 0.37 | 0.005 | 99 | 0.5 | 0.30 | 0.6 |
| Comparative Example C-10 | 50 | 0.81 | 0.37 | 0.005 | 99 | 0.5 | 1.10 | 0.6 |
| Comparative Example C-11 | 50 | 0.81 | 0.37 | 0.005 | 99 | 0.005 | 0.01 | 0.006 |
| Comparative Example C-12 | 50 | 0.81 | 0.37 | 0.005 | 99 | 1 | 1.30 | 1.2 |

| | Silica particles | | | | | | | | |
|---|---|---|---|---|---|---|---|---|---|
| | D1S [nm] | Total content of silica particles with respect to 100 parts by mass of toner particles [parts by mass] | D1S2 [nm] | Content of large silica particles with respect to 100 parts by mass of toner particles | D1S1 [nm] | Content of small silica particles with respect to 100 parts by mass of toner particles | Amount of silica particles separated from toner when toner is washed with water | Toner Median diameter (D50) [μm] | Evaluation Evaluation of image |
| Comparative Example C-1 | 100 | 1.0 | 110 | 0.989 | 15 | 0.011 | 1.2 | 5.0 | C |
| Comparative Example C-2 | 100 | 1.0 | 110 | 0.989 | 15 | 0.011 | 1.2 | 5.0 | C |
| Comparative Example C-3 | 100 | 1.0 | 110 | 0.989 | 15 | 0.011 | 1.2 | 5.0 | C |
| Comparative Example C-4 | 100 | 1.0 | 110 | 0.989 | 15 | 0.011 | 1.2 | 5.0 | C |

TABLE 8-continued

| | | | | | | | | | |
|---|---|---|---|---|---|---|---|---|---|
| Comparative Example C-5 | 100 | 1.0 | 110 | 0.989 | 15 | 0.011 | 1.2 | 5.0 | C |
| Comparative Example C-6 | 100 | 1.0 | 110 | 0.989 | 15 | 0.011 | 1.2 | 5.0 | C |
| Comparative Example C-7 | 100 | 1.0 | 110 | 0.989 | 15 | 0.011 | 1.2 | 5.0 | C |
| Comparative Example C-8 | 100 | 1.0 | 110 | 0.989 | 15 | 0.011 | 1.2 | 5.0 | C |
| Comparative Example C-9 | 4 | 1.0 | 4 | 1.0 | — | — | 0.6 | 5.0 | C |
| Comparative Example C-10 | 500 | 1.0 | 600 | 0.980 | 100 | 0.020 | 2.2 | 5.0 | C |
| Comparative Example C-11 | 100 | 1.0 | 110 | 0.989 | 15 | 0.011 | 1.2 | 5.0 | C |
| Comparative Example C-12 | 100 | 1.0 | 110 | 0.989 | 15 | 0.011 | 1.2 | 5.0 | D |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-159786, filed Aug. 28, 2018, Japanese Patent Application No. 2018-159787, filed Aug. 28, 2018, Japanese Patent Application No. 2018-159788, filed Aug. 28, 2018, Japanese Patent Application No. 2019-150041, filed Aug. 19, 2019, Japanese Patent Application No. 2019-150042, filed Aug. 19, 2019, and Japanese Patent Application No. 2019-150043, filed Aug. 19, 2019, which are hereby incorporated by reference herein in their entirety.

What is claimed is:

1. An image forming apparatus comprising:

an image bearing member;

a charging unit configured to rotate while being brought into contact with the image bearing member;

a voltage applying unit configured to apply only a DC voltage to the charging unit;

an exposure unit configured to form an electrostatic latent image on a surface of the image bearing member subjected to charging treatment;

a developing unit configured to develop the electrostatic latent image through use of toner to form a toner image;

a transfer unit configured to transfer the toner image onto a transfer material;

a cleaning unit configured to clean the toner remaining on the surface of the image bearing member; and a fixing unit configured to fix the toner image transferred onto the transfer material, wherein the charging unit comprises a charging roller, wherein the charging roller has an outermost surface layer including a particle portion and a non-particle portion, wherein the outermost surface layer has a ten-point average roughness Rz of from 1 μm to 20 μm, wherein the non-particle portion of the outermost surface layer has a ten-point average roughness Rz of 1.0 μm or less, wherein the toner contains toner particles, and strontium titanate particles and silica particles that are present on surfaces of the toner particles, wherein the strontium titanate particles satisfy the following conditions:

(i) the strontium titanate particles have a number average particle diameter (D1T) of primary particles of from 10 nm or more to less than 95 nm;

(ii) the strontium titanate particles have an average circularity of from 0.700 or more to 0.920 or less;

(iii) the strontium titanate particles have a maximum peak (a) at a diffraction angle (2θ) of from 32.00 deg or more to 32.40 deg or less in CuKα characteristic X-ray diffraction, the maximum peak (a) has a half width of from 0.23 deg or more to 0.50 deg or less, and an intensity (Ia) of the maximum peak (a) and a maximum peak intensity (Ix) within a range of a diffraction angle (2θ) of from 24.00 deg or more to 28.00 deg or less in the CuKα characteristic X-ray diffraction satisfy the following expression (1);

$$(Ix)/(Ia) \leq 0.010 \quad \text{Expression (1)}$$

(iv) when elements detected by fluorescent X-ray analysis are all assumed to be contained as oxides, a total of contents of strontium oxide and titanium oxide with respect to 100% by mass of a total amount of all the oxides is 98.0% by mass or more, wherein the silica particles have a number average particle diameter (D1S) of primary particles of from 5 nm or more to 300 nm or less, and wherein an amount of the strontium titanate particles separated from the toner when the toner is washed with water is 0.2 time or more as large as an amount of the silica particles separated from the toner when the toner is washed with water.

2. The image forming apparatus according to claim 1, wherein a total content of the silica particles is from 8.0 parts by mass or more to 15.0 parts by mass or less with respect to 100 parts by mass of the toner particles.

3. The image forming apparatus according to claim 1, wherein the silica particles include first silica particles having a number average particle diameter (D1S1) of from 5 nm or more to 20 nm or less and second silica particles having a number average particle diameter (D1S2) of from 80 nm or more to 120 nm or less, and wherein the number average particle diameter (D1T) of the strontium titanate particles, the number average particle diameter (D1S1) of the first silica particles, and the number average particle diameter (D1S2) of the second silica particles have a relationship satisfying the following expression (2)

$$D1S2 > D1T > D1S1 \quad \text{Expression (2).}$$

4. The image forming apparatus according to claim 1, wherein the toner has a median diameter (D50) on a number basis of from 3.0 μm or more to 6.0 μm or less.

5. The image forming apparatus according to claim 1, wherein the amount of the silica particles separated from the toner when the toner is washed with water is 1.75 or less.

6. The image forming apparatus according to claim 1, wherein the amount of the strontium titanate particles separated from the toner when the toner is washed with water is 0.5 or less.

7. An image forming apparatus comprising:

an image bearing member;

a charging unit configured to rotate while being brought into contact with the image bearing member;

a voltage applying unit configured to apply a DC voltage and an AC voltage to the charging unit;

an exposure unit configured to form an electrostatic latent image on a surface of the image bearing member subjected to charging treatment;

a developing unit configured to develop the electrostatic latent image through use of toner to form a toner image;

a transfer unit configured to transfer the toner image onto a transfer material;

a cleaning unit configured to clean the toner remaining on the surface of the image bearing member; and a fixing unit configured to fix the toner image transferred onto the transfer material, wherein the charging unit comprises a charging roller, wherein the charging roller has an outermost surface layer including a particle portion and a non-particle portion, wherein the outermost surface layer has a ten-point average roughness Rz of from 1 μm to 20 μm, wherein the non-particle portion of the outermost surface layer has a ten-point average roughness Rz of 1.0 μm or less, wherein the toner contains toner particles, and strontium titanate particles and silica particles that are present on surfaces of the toner particles, wherein the strontium titanate particles satisfy the following conditions:

(i) the strontium titanate particles have a number average particle diameter (D1T) of primary particles of from 10 nm or more to less than 95 nm;

(ii) the strontium titanate particles have an average circularity of from 0.700 or more to 0.920 or less;

(iii) the strontium titanate particles have a maximum peak (a) at a diffraction angle (2θ) of from 32.00 deg or more to 32.40 deg or less in CuKα characteristic X-ray diffraction, the maximum peak (a) has a half width of from 0.23 deg or more to 0.50 deg or less, and an intensity (Ia) of the maximum peak (a) and a maximum peak intensity (Ix) within a range of a diffraction angle (2θ) of from 24.00 deg or more to 28.00 deg or less in the CuKα characteristic X-ray diffraction satisfy the following expression (1);

$$(Ix)/(Ia) \leq 0.010 \qquad \text{Expression (1)}$$

(iv) when elements detected by fluorescent X-ray analysis are all assumed to be contained as oxides, a total of contents of strontium oxide and titanium oxide with respect to 100% by mass of a total amount of all the oxides is 98.0% by mass or more, wherein the silica particles have a number average particle diameter (D1S) of primary particles of from 5 nm or more to 300 nm or less, and wherein an amount of the strontium titanate particles separated from the toner when the toner is washed with water is from 0.01 time or more to 0.6 time or less as large as an amount of the silica particles separated from the toner when the toner is washed with water.

8. The image forming apparatus according to claim 7, wherein a total content of the silica particles is from 8.0 parts by mass or more to 15.0 parts by mass or less with respect to 100 parts by mass of the toner particles.

9. The image forming apparatus according to claim 7, wherein the silica particles include first silica particles having a number average particle diameter (D1S1) of from 5 nm or more to 20 nm or less and second silica particles having a number average particle diameter (D1S2) of from 80 nm or more to 120 nm or less, and wherein the number average particle diameter (D1T) of the strontium titanate particles, the number average particle diameter (D1S1) of the first silica particles, and the number average particle diameter (D1S2) of the second silica particles have a relationship satisfying the following expression (2)

$$D1S2 > D1T > D1S1 \qquad \text{Expression (2).}$$

10. The image forming apparatus according to claim 7, wherein the toner has a median diameter (D50) on a number basis of from 3.0 μm or more to 6.0 μm or less.

11. The image forming apparatus according to claim 7, wherein the amount of the silica particles separated from the toner when the toner is washed with water is 1.9 or less.

12. The image forming apparatus according to claim 7, wherein the amount of the strontium titanate particles separated from the toner when the toner is washed with water is 0.9 or less.

13. An image forming apparatus comprising:

an image bearing member;

a corona discharge-type charging unit including a discharge electrode arranged so as to be opposed to the image bearing member;

a cleaning unit for the discharge electrode, which is configured to clean a surface of the discharge electrode by being brought into contact with the discharge electrode;

an exposure unit configured to form an electrostatic latent image on a surface of the image bearing member subjected to charging treatment;

a developing unit configured to develop the electrostatic latent image through use of toner to form a toner image;

a transfer unit configured to transfer the toner image onto a transfer material;

a cleaning unit configured to clean the toner remaining on the surface of the image bearing member; and a fixing unit configured to fix the toner image transferred onto the transfer material, wherein the toner contains toner particles, and strontium titanate particles and silica particles that are present on surfaces of the toner particles, wherein the strontium titanate particles satisfy the following conditions:

(i) the strontium titanate particles have a number average particle diameter (D1T) of primary particles of from 10 nm or more to less than 95 nm;

(ii) the strontium titanate particles have an average circularity of from 0.700 or more to 0.920 or less;

(iii) the strontium titanate particles have a maximum peak (a) at a diffraction angle (2θ) of from 32.00 deg or more to 32.40 deg or less in CuKα characteristic X-ray diffraction, the maximum peak (a) has a half width of from 0.23 deg or more to 0.50 deg or less, and an intensity (Ia) of the maximum peak (a) and a maximum peak intensity (Ix) within a range of a diffraction angle (2θ) of from 24.00 deg or more to 28.00 deg or less in the CuKα characteristic X-ray diffraction satisfy the following expression (1);

$$(Ix)/(Ia) \leq 0.010 \quad \text{Expression (1)}$$

(iv) when elements detected by fluorescent X-ray analysis are all assumed to be contained as oxides, a total of contents of strontium oxide and titanium oxide with respect to 100% by mass of a total amount of all the oxides is 98.0% by mass or more, wherein the silica particles have a number average particle diameter (D1S) of primary particles of from 5 nm or more to 300 nm or less, and wherein an amount of the strontium titanate particles separated from the toner when the toner is washed with water is from 0.01 time or more to 0.9 time or less as large as an amount of the silica particles separated from the toner when the toner is washed with water.

14. The image forming apparatus according to claim 13, wherein the amount of the silica particles separated from the toner when the toner is washed with water is 2.5 or less.

15. The image forming apparatus according to claim 13, wherein the amount of the strontium titanate particles separated from the toner when the toner is washed with water is 1.5 or less.

16. The image forming apparatus according to claim 13, wherein the silica particles include first silica particles having a number average particle diameter (D1S1) of from 5 nm or more to 20 nm or less and second silica particles having a number average particle diameter (D1S2) of from 80 nm or more to 120 nm or less, and wherein the number average particle diameter (D1T) of the strontium titanate particles, the number average particle diameter (D1S1) of the first silica particles, and the number average particle diameter (D1S2) of the second silica particles have a relationship satisfying the following expression (2)

$$D1S2 > D1T > D1S1 \quad \text{Expression (2).}$$

17. The image forming apparatus according to claim 13, wherein the toner has a median diameter (D50) on a number basis of from 3.0 μm or more to 6.0 μm or less.

* * * * *